US005869796A

United States Patent [19]

Matsuda et al.

[11] Patent Number: 5,869,796

[45] Date of Patent: Feb. 9, 1999

[54] CONTACT DEVICE

[75] Inventors: Setsuyuki Matsuda; Hiroyuki Hama, both of Tokyo, Japan

[73] Assignee: Mitsubishi Denki Kabushiki Kaisha, Tokyo, Japan

[21] Appl. No.: 873,238

[22] Filed: Jun. 11, 1997

[30] Foreign Application Priority Data

Feb. 5, 1997 [JP] Japan ..... 9-022419

[51] Int. Cl.[6] ..... H01H 9/30; H01H 33/02; H01H 1/12

[52] U.S. Cl. ..... 218/48; 218/146; 200/255

[58] Field of Search ..... 218/48–50, 65, 218/70, 74, 75, 77, 79, 80, 146; 200/255, 259–261, 249–251; 439/188, 251, 578, 821, 843, 851, 856, 857

[56] References Cited

U.S. PATENT DOCUMENTS

| | | | |
|---|---|---|---|
| 3,854,019 | 12/1974 | Handke | 218/48 |
| 3,982,806 | 9/1976 | Wilson et al. | 439/248 |
| 4,087,668 | 5/1978 | Nakanishi et al. | 200/254 |
| 4,345,129 | 8/1982 | Czech et al. | 200/253.1 |
| 4,846,695 | 7/1989 | Iwabuchi et al. | 439/17 |

FOREIGN PATENT DOCUMENTS

| | | | |
|---|---|---|---|
| 61-82367 | 5/1985 | Japan | H01R 4/48 |
| 63-125321 | 8/1988 | Japan | H01H 33/02 |
| 64-4067 | 1/1989 | Japan | H01R 4/48 |
| 1-86070 | 6/1989 | Japan | H01R 4/48 |

*Primary Examiner*—J. R. Scott

*Attorney, Agent, or Firm*—Burns, Doane, Swecker & Mathis, LLP

[57] ABSTRACT

A contact device has a pair of flanges which extend inward in the radial direction from both ends of an annular shield, and a plurality of contact pieces which are arrayed in the circumferential direction in a space formed by the shield and the pair of flanges, the axial direction thereof being matched to the parallel direction with the axial center of the shield. Contact sections are provided on the outer peripheral surfaces at both ends of each contact piece. The contact device also has a plurality of rod-shaped elastic members disposed in the circumferential direction on the flanges, each of the elastic members being cantilever-fixed to the flange in such a manner that one end thereof is secured to an inner edge surface of the flange and the other end thereof is allowed to extend along the axial center of the shield into a space formed by the shield and the pair of flanges. The rod-shaped elastic members elastically support the contact pieces to restrict the contact pressure of the contact sections. The contact device is capable of carrying large current while controlling an increase of the outside diameter thereof.

20 Claims, 13 Drawing Sheets

CONTACT DEVICE

BACKGROUND OF THE INVENTION

1. Field of the Invention

The present invention relates to a contact device used for a sliding contact of conductors of electrical equipment such as a gas insulated switch gear.

2. Description of Related Art

FIG. 14 is a sectional view illustrative of a conventional contact device described, for example, in Japanese Unexamined Utility Model Publication No. 61-82367.

In the drawing, coaxially formed on the end of a first conductor 1 and the end of a second conductor 2, which are arranged to be opposed to each other, are a contact section 1*a* and a contact section 2*a*, respectively, which have smaller diameters. A tulip contact 4 composed of many contact pieces 3 radially arranged along the axis is secured by a screw 6 via a holding plate 5 onto the contact section 1*a* of the first conductor 1. The contact section 2*a* of the second conductor 2 is detachably and slidably connected to the open end of the tulip contact 4. Garter springs 7 are fitted, two each, into both ends of the tulip contact 4 from the end where the outer periphery is located. The garter springs 7 are composed of helical springs, the overall length of each of which is smaller than the circumference of the circle that is circumscribed with the contact pieces 3; they impart contact pressure between contact sections 3*a*, 3*b* of each contact piece 3 and the contact sections 1*a*, 2*a*.

On the inner wall of a cylindrical shield 8, two guide plates 9 lying between adjacent contact pieces 3 are symmetrically installed along the axis. Two fixing leaf springs 10 are mounted in positions which are 90 degrees shifted from the guide plates 9; they are bent into a trapezoid shape to press the outer peripheries of the contact pieces 3. The shield 8 is pushed in from the opened end of the tulip contact 4 secured to the contact section 1*a* so that the guide plates 9 are inserted between adjoining contact pieces 3. This causes the leaf springs 10 to be pushed and deformed by the contact pieces 3; the elastic force of the leaf springs 10 installs the shield 8 to the tulip contact 4 in such a manner that it covers the tulip contact 4.

In the conventional contact device thus configured, the tulip contact 4 is attached to the contact section 1*a* of the first conductor 1 and the contact section 2*a* of the second conductor 2 is inserted from the opened end of the tulip contact 4. The tightening force of the garter springs 7 ensures the electrical contact between the contact sections 1*a*, 2*a* of the first and second conductors 1, 2 and the contact sections 3*a*, 3*b* of the contact pieces 3. This allows current to flow between the first and second conductors 1, 2 through the tulip contact 4.

The guide plates 9 are provided between adjoining contact pieces 3 to prevent the contact pieces 3 from falling. The shield 8 covers the tulip contact 4, thereby easing the concentration of electric field strength attributable to the projections and depressions on the outer peripheral portions of the contact pieces 3 and the garter springs 7.

The conventional contact device is used for connecting conductors of electrical equipment such as a gas insulated switch gear; it can be disassembled for transportation and reassembled at a site, where it is used, to permit easy connection between conductors.

The contact section 2*a* of the second conductor 2 is configured so that it slidably moves along the axis with respect to the contact section 3*b* of the contact piece 3; therefore, even if the first and second conductors 1 and 2 develop a temperature difference due to the supply of current or a change in ambient temperature and consequently expand or shrink, the electrical connection between the first and second conductors is secured. Moreover, the contact device can also be applied to a movable contact in such applications as a breaker or a disconnecting switch wherein a conductor is slid against a contact to admit current.

The contact device thus configured is known as a tulip contact or a polygon contact.

Thus, the conventional contact device has the garter springs 7 provided on the outer peripheries of the contact pieces 3; therefore, the outside diameter of the shield 8, that is, the outside diameter of the contact device is larger than the outside diameters of the first and second conductors 1 and 2. This has been posing a problem in that the outside diameter of the contact device unavoidably becomes even larger especially when the outside diameters of the contact sections 1*a* and 2*a* are increased to expand the contact area for carrying large current. This has resulted in a problem in that, when the conventional contact device is used, for example, in a gas insulated switch gear where a conducting section is placed in a tank, the diameter of the tank inevitably becomes large to secure a sufficient insulation distance.

Furthermore, when using the contact device, which has the tulip contact, for an application involving large current, many contact pieces 3 must be arranged in parallel in order to increase the contact area. In the conventional contact device, since the contact pressure is imparted to the contact pieces 3 by the tightening force of the garter springs 7, as the number of the contact pieces 3 increases, the component force which works as the contact pressure accordingly decreases. For this reason, it has been necessary to increase the number of the garter springs 7 or to employ larger garter springs 7 for providing greater tightening force to secure sufficient contact pressure, presenting a problem of deteriorated assemblability and an increased size of the device. In addition, a small angular difference causes great variations in the component force working as the contact pressure. This has led to greater chance of contact failures.

SUMMARY OF THE INVENTION

The present invention has been made with a view toward solving the problems, and it is an object of the invention to provide a contact device which is capable of carrying large current while controlling an increase of the outside diameter thereof.

In order to achieve the above object, according to one aspect of the present invention, there is provided a contact device equipped with: an annular shield; a pair of annular flanges provided on both ends of the shield so that they extend inward in the radial direction; a plurality of contact pieces which have contact sections projecting on the outer peripheral surfaces of both ends thereof and which are arranged in the circumferential direction in a space formed by the shield and the pair of the flanges with the axial direction thereof matched to the parallel direction with the axial center of the shield; and a plurality of rod-shaped elastic members arrayed on the flanges in the circumferential direction, each of the elastic members being cantilever-fixed to the flange in such a manner that one end thereof is secured to an inner edge surface of the flange and the other end thereof is allowed to extend into the space formed by the shield and the flanges along the axial center of the shield, and which elastically support the plurality of the contact pieces, respectively, to restrict the contact pressure of the contact sections.

According to another aspect of the present invention, there is provided a contact device equipped with: an annular shield attached to one of a pair of conductors to be electrically connected; a pair of annular flanges which are provided on the inner side of the shield so that they extend inward in the radial direction and face each other in the parallel direction with the axial center; a plurality of slit-like notches which are provided in the circumferential direction on the inner edge surface of the flange of the pair of the flanges, the flange being on the other end of the shield, and which extend in the radial direction; a plurality of contact pieces which are disposed in the circumferential direction in a space formed by the shield and the flanges in such a manner that each axial direction of the contact pieces is matched to the parallel direction with the axial center of the shield, wherein one contact section is projected on the radial outer surface of each one end of the contact pieces, whereas the other contact section is projected on the radial inner surface of each other end of the contact pieces, a bore is provided on the end surface of each one end of the contact pieces, and a stopper is projected on the end surface of each other end of the contact pieces and inserted in the slit-like notch; a plurality of rod-shaped elastic members arrayed on the flanges in the circumferential direction, each of the elastic members being cantilever-fixed to the flange in such a manner that one end thereof is secured to an inner edge surface of the flange located in one end side of the shield and the other end thereof is allowed to extend into a space formed by the shield and the flanges along the axial center of the shield, which each other end of the elastic members is inserted in the bore to urge the one contact section outward in the radial direction so as to restrict the contact pressure of the one contact section; and a plurality of helical springs which are respectively provided in a compressed state between the radial outer surface of the other end of the contact piece and the shield to restrict the contact pressure of the other contact section.

According to still another aspect of the present invention, there is provided a contact device equipped with: an annular shield attached to one of a pair of conductors to be electrically connected; an annular flange which is provided on other end of the shield so that it extends inward in the radial direction; a plurality of contact pieces which are disposed in the circumferential direction in a space formed by the shield and the flange in such a manner that each axial direction of the contact pieces is matched to the parallel direction with the axial center of the shield, wherein one contact section is projected on the radial outer surface of each one end of the contact pieces, whereas the other contact section is projected on the radial inner surface of each other end of the contact pieces, and a groove is formed on the inner radial surface of the contact pieces in the axial direction; a plurality of rod-shaped elastic members arrayed on the flange in the circumferential direction, each of the elastic members being cantilever-fixed to the flange in such a manner that one end thereof is secured to an inner edge surface of the flange and the other end thereof is allowed to extend into a space formed by the shield and the flange along the axial center of the shield, which each of the elastic members is placed in the groove to urge the one contact section outward in the radial direction so as to hold the one contact section against the inner peripheral wall surface of the shield, thereby restricting the contact pressure of the one contact section; and a plurality of helical springs which are respectively provided in a compressed state between the radial outer surface of the other end of the contact piece and the shield to restrict the contact pressure of the other contact section.

DESCRIPTION OF THE PREFERRED EMBODIMENTS

The embodiments of the present invention will be described.

First Embodiment

Figure 1:
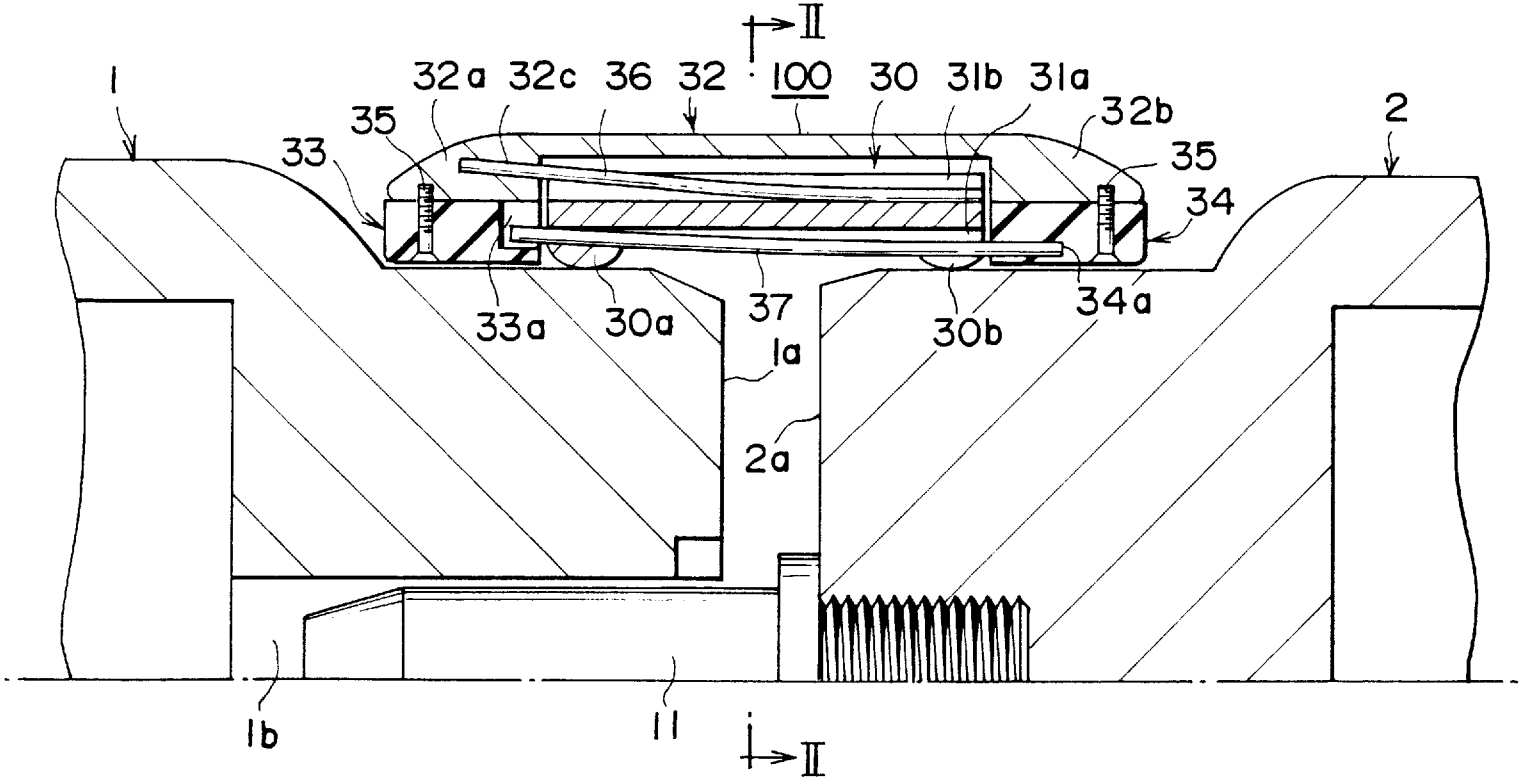
FIG. 1 is a sectional view illustrative of a contact device in accordance with a first embodiment of the present invention.
Figure 2:
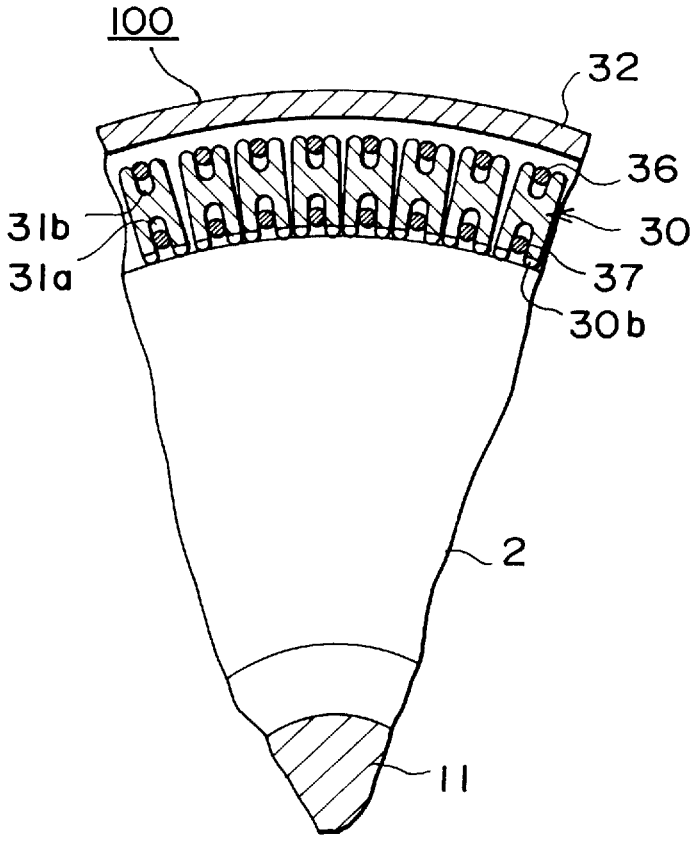
FIG. 2 is a fragmentary view taken in the direction of the arrow along the line II—II of FIG. 1.
Figure 14:
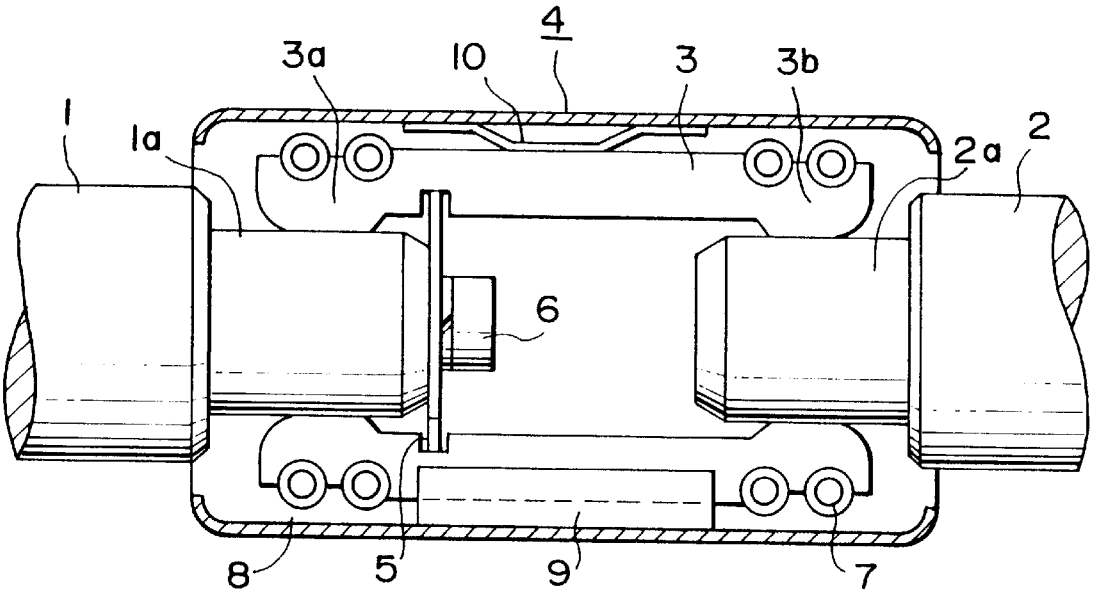
FIG. 14 PRIOR ART
FIG. 14 is a sectional view illustrative of a conventional contact device.

FIG. 1 is a sectional view illustrative of a contact device in accordance with a first embodiment of the present invention; and FIG. 2 is a fragmentary view taken in the direction of the arrows along the line II—II of FIG. 1. In the drawings, the components that are the same or corresponding to those of the conventional contact device shown in FIG. 14 are assigned the same reference numerals, and the description thereof will be omitted.

In FIG. 1 and FIG. 2, a contact piece 30 has an H-shaped section; it is provided with grooves 31*a* and 31*b*, which extend in the axial direction, on the inner and outer surfaces thereof in the radial direction. A contact section 30*a* is provided to cover the groove 31*a* on the radial inner surface on one end thereof, while a contact section 30*b* is provided to expose the groove 31*a* on the radial inner surface on the other end thereof. The contact piece 30 is made of a copper alloy, and the surfaces of the contact sections 30*a* and 30*b* are provided with silver plating. Silver plating is provided also on the outer peripheral surfaces of the contact sections 1*a* and 2*a* of the first and second conductors 1 and 2, respectively.

A cylindrical shield 32 is made of copper or aluminum; a recessed section having a width slightly greater than the axial length of the contact piece 30 is formed on the inner peripheral wall surface thereof. A plurality of the contact pieces are provided and arranged in the circumferential direction in the shield 32, the axial directions of the contact pieces 30 being matched to the direction of the axial center of the shield 32. Provided on the inner end surface of a flange section 32*a* of the shield 32 are bores 32*c* in which rod springs to be discussed later are press-fitted (i.e., "Press-fit") and which are provided at equiangular pitches in the circumferential direction.

Mounting rings 33, 34 are made of an electrical insulator such as fiber reinforced plastics (FRP) or Teflon; they are respectively clamped and fixed onto the flange section 32*a* and a flange section 32*b* from the inner peripheral side by mounting bolts 35 which are securing members. Bores 34*a* in which rod springs, to be discussed later on the inner end surface of the mounting ring 34 at equiangular pitches in the circumferential direction. Notches 33*a* for holding the distal ends of the rod springs press-fitted in the mounting ring 34 are provided on the inner end surface of the mounting ring 33 in the circumferential direction at equiangular pitches.

The bores 32*c*, 34*a*, and the notches 33*a* are all formed at the equiangular pitches, and the shield 32 and the mounting rings 33, 34 are made integral so that the bores 32*c*, 34*a* and the notched 33*a* are matched in the circumferential direction. The flange sections 32*a*, 32*b* and the mounting rings 33, 34 constitute the flanges which extend radially inward on both ends of the shield.

One end of a rod spring 36 serving as a rod-shaped elastic member is press-fitted in each bore 32*c* and allowed to extend in parallel to the axial center of the shield 32 into the recessed section formed by the shield 32 and the mounting rings 33, 34, the rod spring 36 being cantilever-fixed on the flange section 32*a*. A plurality of rod springs 36 are provided and arranged on the flange section 32*a* at equiangular pitches in the circumferential direction.

The other ends of the respective rod springs 36 are inclined so that they gradually approach the axial center of the shield 32. The respective rod springs 36 are placed in the grooves 31*b* of the respective contact pieces 30 which are arranged in the circumferential direction in the recessed section formed by the shield 32 and the mounting rings 33, 34; the other ends thereof are pressed against the bottoms of the grooves 31*b* to urge the contact sections 30*b* of the contact pieces 30 inward in the radial direction.

One end of a rod spring 37 serving as a rod-shaped elastic member is press-fitted in each bore 34*a* and allowed to extend in parallel to the axial center of the shield 32 into the recessed section formed by the shield 32 and the mounting rings 33, 34, the rod spring 37 being cantilever-fixed on the mounting ring 34. A plurality of rod springs 37 are provided and arranged on the mounting ring 34 at equiangular pitches in the circumferential direction.

The other ends of the respective rod springs 37 are inclined so that they gradually approach the axial center of the shield 32. The respective rod springs 37 are placed in the grooves 31*a* of the respective contact pieces 30 which are arranged in the circumferential direction in the recessed section formed by the shield 32 and the mounting rings 33, 34; the other ends thereof are pressed against the contact sections 30*a* to urge the contact sections 30*a* of the contact pieces 30 inward in the radial direction. The other ends of the respective rod springs 37 are placed in the notches 33*a* of the mounting ring 33.

A guide pin 11 is secured at the axial center of the contact section 2*a* of the second conductor 2.

The rod springs 36, 37 are made using piano wire which has a round section; the outside diameters thereof are made slightly smaller than the widths of the grooves 31*a*, 31*b*, and the notches 33*a*.

To assemble a contact device configured as described above, a plurality of the rod springs 36 are first press-fitted in the bores 32*c*, and cantilever-fixed on the flange section 32*a* of the shield 32 so that they are arranged in the circumferential direction. Then, the mounting ring 33 is secured to the flange section 32*a* by the mounting bolts 35 so that the notches 33*a* match the bores 32*c* in the circumferential direction. Further, a jig which is not shown and which is formed to have the same shape as the first conductor 1 is inserted from the end where the mounting ring 33 is located.

Next, the contact piece 30 is pushed in so that the rod spring 36 is placed in the groove 31*b*. The contact piece 30 is urged inward in the radial direction by the urging force of the rod spring 36; the contact section 30*a* is retained by being held against the outer peripheral surface of the jig. Thus, a plurality of the contact pieces 30 are pushed in one after another and arranged at equiangular pitches in the circumferential direction.

A plurality of the rod springs 37 are press-fitted in the respective bores 34*a* and arranged in the circumferential direction, being cantilever-fixed on the mounting ring 34. The rod springs 37 are passed through the grooves 31*a*, the distal ends thereof reaching the inside of the notches 33*a*. The mounting ring 34 is secured to the flange section 32*b* by the mounting bolts 35.

After that, the jig is drawn out to complete the assembly of a contact device 100.

A pair of rod springs 36, 37 put in the grooves 31*a*, 31*b* of each contact piece 30 prevent the contact pieces 30 from falling in the circumferential direction.

The bottoms of the grooves 31*a* of the contact pieces 30 are held against the proximal ends of the rod springs 37 to prevent the contact sections 30*b* from moving inward radially. Further, the distal ends of the rod springs 37 are held against the bottoms of the notches 33*a* to prevent the contact sections 30*a* of the contact pieces 30 from moving inward radially.

The procedure for connecting the first and second conductors 1 and 2 by employing the contact device 100 will now be described.

First, the mounting ring 33 of the contact device 100 is inserted in the contact section 1*a* of the first conductor 1. At this time, in the contact device 100, the contact section 30*a* of each contact piece 30 is pushed in against the urging force of the rod spring 37 inward in the radial direction while sliding on the outer peripheral surface of the contact section 1*a*. Thus, the contact device 100 is retained on the contact section 1*a* by the urging force of the rod spring 37.

Then, the second conductor 2 is inserted from the end where the mounting ring 34 of the contact device 100 is located. At this time, the guide pin 11 is inserted in the axial bore 1*b* of the first conductor 1, and the second conductor is inserted concentrically with the first conductor 1 without being decentered. The contact section 2*a* of the second conductor 2 is pushed in against the urging force of the rod spring 36 inward in the radial direction while sliding on the outer peripheral surface of each contact section 30*b* of the contact device 100.

Thus, the contact section 30*a* is held against the outer peripheral surface of the contact section 1*a* by the urging force of the rod spring 37, and the contact section 30*b* is held against the outer peripheral surface of the contact section 2*a* by the urging force of the rod spring 36, thereby securing the electrical connection between the first and second conductors 1, 2 via the contact device 100.

According to the first embodiment, a plurality of the contact pieces 30, each of which has the axial 31*a* and 31*b* on the radial inner and outer surfaces thereof, respectively, and has the H-shaped section, are arranged in the circumferential direction, the axial directions of the contact pieces 30 being matched to the axial direction of the shield 32; and the cantilevered rod springs 36, 37 are respectively placed in the grooves 31*a*, 31*b* to urge the respective contact pieces 30 inward in the radial direction; therefore, the rod springs 36, 37 do not jut out of the outer peripheries of the contact pieces 30, thus preventing the outside diameter of the shield 32 from being increased and enabling the contact device 100 to be made smaller accordingly. Moreover, even if the distance between the first conductor 1 and the second conductor 2 changes due to changes due to the thermal contraction, the contact sections 1*a*, 2*a* of the first and second conductors 1, 2 are displaced while keeping themselves in contact with the contact sections 30*a*, 30*b*; therefore, the first embodiment can be applied also for the connection between conductors carrying large current and also for the movable contact used in a breaker, disconnecting switch, etc.

Since the contact pressure is applied to the respectively contact pieces 30 by the pair of rod springs 36, 37, adequate contact pressure is always secured by the rod springs 36, 37 and variations in the contact pressure can be controlled at the same time regardless of the number of arranged contact pieces 30.

Hence, the occurrence of contact failures attributable to the variations in the contact pressure applied to the contact pieces 30 is controlled, enabling good current carrying performance to be accomplished. Moreover, unlike the conventional devices, increasing the number of arrayed contact pieces 30 to carry large current no longer requires increasing the number of the garter springs 7 or employing lager garter springs 7 which provide higher tension, thus making it possible to minimize the sacrifice in the assemblability of the contact device 100 and to control an increase of the size thereof.

Furthermore, the other end of the rod spring 37 is held against the bottom of the notch 33*a* provided on the mounting ring 33, while the bottom of the groove 31*a*, on the side where the contact section 30*b* is located, is held against the proximal end of the rod spring 37 so as to restrict the projection of the contact pieces 30 in the inward radial direction. This prevents the contact pieces 30 from moving excessively in the inward radial direction; therefore, the first and second conductors 1, 2 can be easily fitted in the contact sections 1*a*, 2*a*, respectively, permitting easier assembly.

The shield 32 is provided so that it covers a plurality of the contact pieces 30 arrayed in the circumferential direction; therefore, the concentration of electric field can be prevented, enabling good insulation characteristic to be achieved.

The mounting rings 33, 34 are composed of FRP or Teflon which is an insulator to prevent current from being branched when the current is supplied. This prevents such problems as fusing.

Since the rod springs 36, 37 have round sections, the bores 32*c*, 34*a* provided in the flanged section 32*a* and the mounting ring 34 for mounting the rod springs 36, 37 can be made round, permitting easier boring.

The respective contact pieces 30 are elastically supported by the rod springs 36, 37, and the mounting rings 33, 34 are installed on the shield 32 so as to allow easier assembly of the contact device. The number of the arrayed contact pieces 30 can be changed according to the magnitude of the current to be supplied, thus allowing a highly versatile contact device to be achieved.

Since a plurality of the rod springs 36, 37 are provided at equiangular pitches in the circumferential direction, the contact pieces 30 can be arrayed at equiangular pitches in the circumferential direction, enabling the electrical connection paths for the first and second conductors 1, 2 to be uniformly formed in the circumferential direction. For small current, however, it is not always required that the contact pieces 30 be arrayed at equiangular pitches in the circumferential direction.

When the contact device 100 is applied to a gas insulated switch gear placed in the outer casing of a circular tube filled with an insulating gas in an apparatus, the entire apparatus including the outer casing can be reduced in size since the outside diameter of the contact device 100 which juts out at an outermost end where the electric field strength is the highest is smaller. This is extremely advantageous in the aspects of economy and installation.

In the first embodiment described above, the piano wire is used for the rod springs 36, 37; however, other materials such as spring steel, nonmagnetic stainless wire which does not easily allow current to flow through, or flexible phosphor bronze wire may be used for the rod springs 36, 37, in place of the piano wire.

Likewise, although the rod springs 36, 37 in the first embodiment are formed to have circular sections, the sections of the rod springs 36, 37 are not limited to the circular sections; they may have square sections instead.

Second Embodiment

In the first embodiment, the contact device 100 are fitted onto the contact sections 1*a*, 2*a* of the first and second conductors 1, 2, whereas in the second embodiment, a contact device 101 is fixed to the first conductor 1.

Figure 3:
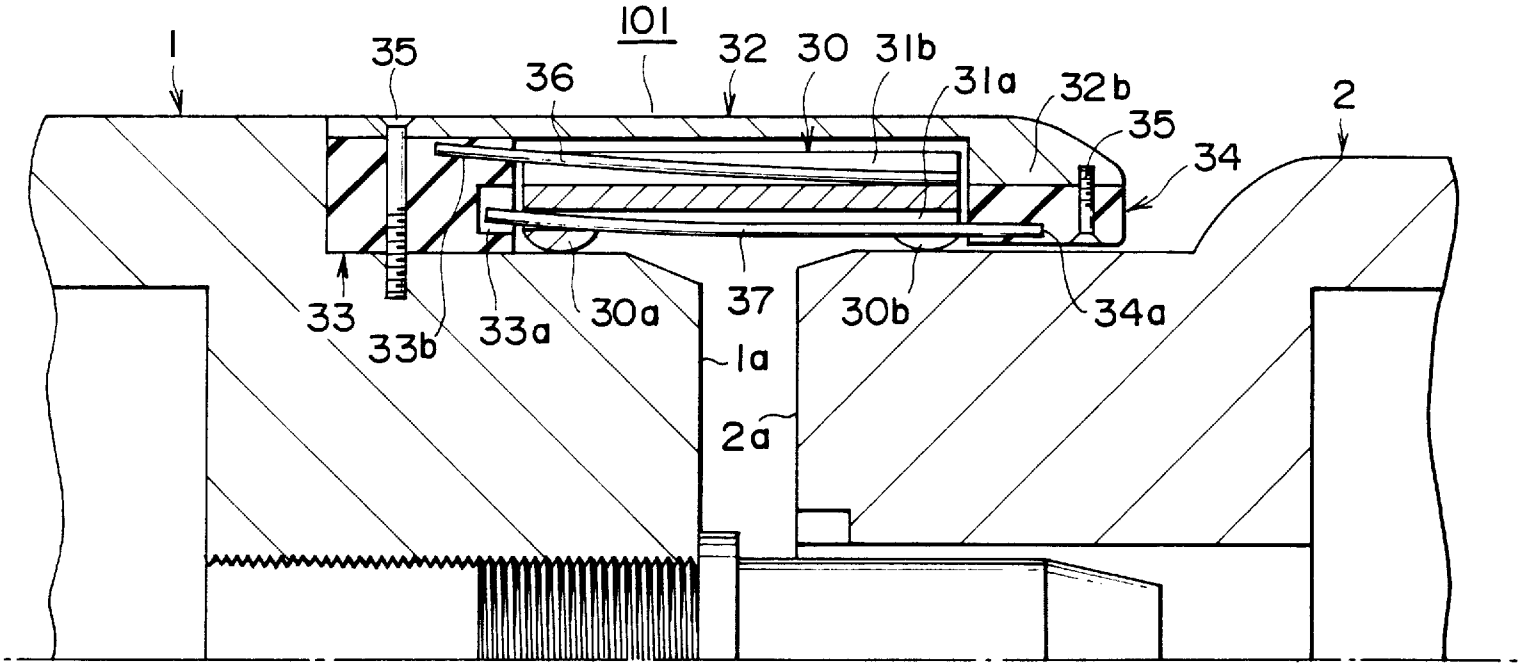
FIG. 3 is a sectional view illustrative of a contact device in accordance with a second embodiment of the present invention.

In the second embodiment, as shown in FIG. 3, the mounting ring 33 is provided with a bore 33*b* for securing the rod spring 36, and the rod spring 36 is press-fitted in the bore 33*b* so that it is cantilever-fixed by the mounting ring 33. The contact device 101 is secured to the contact section 1*a* of the first conductor 1 from the outer periphery end by the mounting bolts 35.

Before electrically connecting conductors by employing this type of contact device, the contacting portions between the contact sections 1*a* and 30*a* and between the contact sections 2*a* and 30*b*, i.e. the outer peripheral surfaces of the contact sections 1*a*, 2*a*, 30*a*, and 30*b* are provided with silver plating to improve the current carrying performance. In the second embodiment, since the contact device 101 is fixed to the first conductor 1, the contact section 30*a* is in contact only within a limited circumferential area of the contact section 1*a*. This means that less silver plating is provided on the outer peripheral surface of the contact section 1*a* of the first conductor 1, thus saving cost accordingly.

Likewise, since the contact device 101 is fixed to the first conductor 1, only the area where the contact device 101 moves while in contact on the second conductor 2 need to be considered in designing the device; therefore, its length in the axial direction can be decreased accordingly.

Third Embodiment

Figure 4:
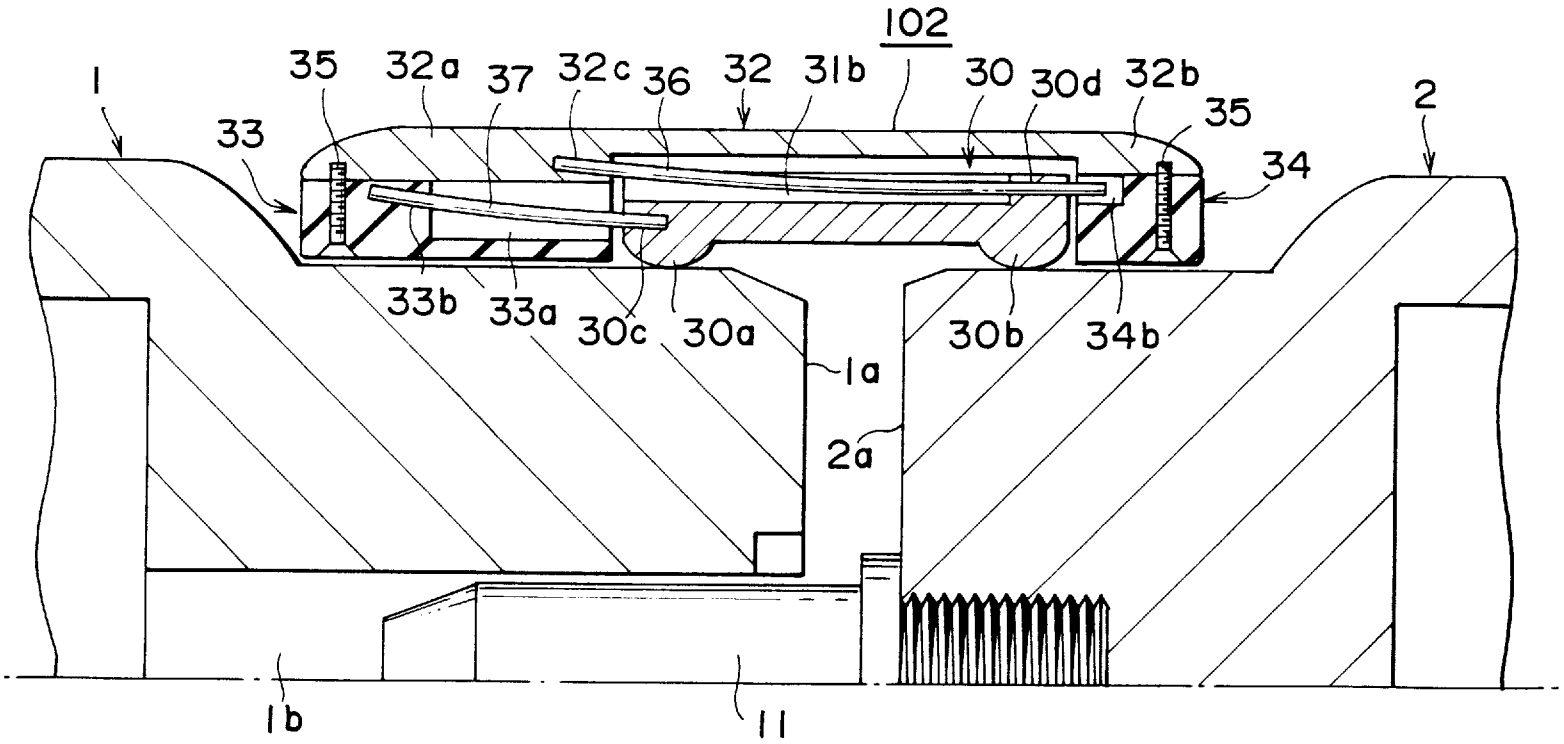
FIG. 4 is a sectional view illustrative of a contact device in accordance with a third embodiment of the present invention.

FIG. 4 is a sectional view illustrative of a contact device in accordance with a third embodiment of the present invention.

In the drawing, the radial outer surface of a contact piece 30 is provided with a groove 31*b* which extends in the axial direction. The other end of the groove 31*b* is closed, and a through hole 30*d* in which a rod spring 36 is inserted is bored at the closed portion. The surface of one end of the contact piece 30 is provided with a bore 30*c* in which a rod spring 37 is inserted. Further, the contact sections 30*a*, 30*b* are provided in the radial direction on the inner surfaces at both ends of the contact piece 30. The bore 30*c* and the through hole 30*d* are formed to have larger diameters than the outside diameters of the rod springs 36 and 37.

Provided on the inner end surface of the mounting ring 33 are the bores 33*b*, in which the rod springs 37 are press-fitted, and slit-shaped notches 33*a* for holding the rod springs 37, the bores 33*b* and the notches 33*a* being arranged at equiangular pitches in the circumferential direction. The inner end surface of the mounting ring 34 is provided with notches 34*b* for holding the distal ends of the rod springs 36, the notches 34*b* being arranged at equiangular pitches in the circumferential direction. In this embodiment, the bores 32*c*, 33*b* and the notches 33*a*, 34*b* are formed at equiangular pitches. The mounting rings 33, 34 are secured to and made integral with the flange sections 32*a*, 32*b* of the shield 32 by the mounting bolts 35 so that the bores 32*c*, 33*b* and the notches 33*a*, 34*b* match in the circumferential direction.

One end of the rod spring 36 is press-fitted in each bore 32*c*; the rod spring is allowed to extend, along the axis of the shield 32, into a recessed section formed by the shield 32 and the mounting rings 33, 34, then cantilever-fixed on the flange section 32*a*. A plurality of the rod springs 36 are arranged on the flange section 32*a* at equiangular pitches in the circumferential direction.

The other ends of the respective rod springs 36 are inclined so that they gradually approach the axial center of the shield 32. The respective rod springs 36 are placed in the grooves 31*b* of the respective contact pieces 30 which are arranged in the circumferential direction in the recessed section formed by the shield 32 and the mounting rings 33, 34; the other ends thereof are inserted in the through holes 30*d* and placed in the notches 34*b*. The rod springs 36 urge the contact sections 30*b* of the contact pieces 30 in the radial inward direction via the inner wall surface of the through holes 30*d*. The distal ends of the rod springs 36 are pressed against the bottoms of the notches 34*b* to prevent them from moving any further inward in the radial direction.

One end of the rod springs 37 is press-fitted in each bore 33*b* and allowed to extend along the axial center of the shield 32 in the recessed section formed by the shield 32 and the mounting rings 33, 34, then cantilever-fixed on the mounting ring 33. A plurality of the rod springs 37 are provided and arranged on the mounting ring 33 at equiangular pitches in the circumferential direction.

The other ends of the respective rod springs 37 are inclined so that they gradually approach the axial center of the shield 32. The other ends of the respective rod springs 37 are allowed to extend through the notches 33*a* and inserted in the respective bores 30*c* of the respective contact pieces 30. The rod springs 37 urge the contact sections 30*a* of the contact pieces 30 in the radial inward direction through the inner wall surfaces of the bores 30*c*. The other ends of the respective rod springs 37 are held against the bottoms of the notches 33*a* to prevent them from moving any further inward in the radial direction.

The rest of the third embodiment is identical to the first embodiment described above.

To assemble a contact device 102 configured as described above, a plurality of the rod springs 36 are first press-fitted in the bores 32*c*, and cantilever-fixed on the flange section 32*a* of the shield 32 so that they are arranged in the circumferential direction. A plurality of the rod springs 37 are press-fitted in the bores 33*b* through the notches 33*a*, and cantilever-fixed at the mounting ring 33 at the axis thereof to array the rod springs 37 in the circumferential direction. The mounting ring 33 is secured to the flange section 32*a* by the mounting bolts 35 from the inner peripheral end in such a manner that the notches 33*a* and the bores 33*b* coincide with the bores 32*c* in the circumferential direction. Further, a jig which is not shown and which is formed to have the same shape as the first conductor 1 is inserted from the end where the mounting ring 33 is located.

Next, the contact piece 30 is pushed in so that the rod spring 36 is placed in the groove 31*b* and inserted in the through hole 30*d*. At this time, the other end of the rod spring 37 is inserted in the bore 30*c*. The contact pieces 30 is urged inward in the radial direction by the urging force of the rod springs 36, 37; the contact section 30*a* is retained by being held against the outer peripheral surface of the jig. Thus, a plurality of the contact pieces 30 are pushed in one after another and arranged in the circumferential direction.

Then, the mounting ring 34 is applied to the flange section 32*b* so that the other ends of the respective rod springs 36 jutting out of the through holes 30*d* are fitted in the notches 34*b*. After that, the mounting ring 34 is secured to the flange section 32*b* by the mounting bolts 35 from the inner peripheral side, then the jig is drawn out to complete the assembly of the contact device 102.

The rod springs 36 passed through the through holes 30*d* and the rod springs 37 inserted in the bores 30*c* prevent the contact pieces 30 from falling in the circumferential direction.

The other ends of the rod springs 36 cantilever-fixed on the flange section 32*a* are held against the inner wall surfaces of the through holes 30*d* to urge the contact sections 30*b* of the contact pieces 30 inward in the radial direction. Likewise, the other ends of the rod springs 37 cantilever-fixed to the mounting ring 33 are held against the inner wall surfaces of the bores 30*c* to urge the contact sections 30*a* of the contact pieces 30 inward in the radial direction.

The other ends of the rod springs 36 are held against the bottoms of the notches 34*b* to prevent the contact sections 30*b* of the contact pieces 30 from moving any further inward in the radial direction. Likewise, the other ends of the rod springs 37 are held against the bottoms of the notches 33*a* to prevent the contact sections 30*a* of the contact pieces 30 from moving any further inward in the radial direction.

When the contact device 102 thus configured is used for the electrical connection between the first and second conductors 1, 2, the urging force of the rod springs 36 cantilever-fixed to the flange section 32*a* holds the contact section 30*b* against the outer peripheral surface of the contact section 2*a* of the second conductor 2, and the urging force of the rod springs 37 cantilever-fixed to the mounting ring 33 holds the contact section 30*a* against the outer peripheral surface of the contact section 1*a* of the first conductor 1. This secures the electrical connection between the first conductor 1 and the second conductor 2 through the contact device 102.

Hence, the third embodiment also provides the same advantages as those imparted by the first embodiment described above.

In the third embodiment, the other ends of the rod springs 37 cantilever-fixed to the mounting ring 33 are inserted in the bores 30*c* provided on one end of the contact pieces 30 to urge the contact sections 30*a* of the contact pieces 30 inward in the radial direction. Therefore, according to the third embodiment, although the axial length of the shield 32 is increased, the need for providing the inner surfaces of the contact pieces 30 with the grooves 31*a* can be obviated. This permits an increased area for carrying current and also permits improved machinability of the contact pieces 30.

Fourth Embodiment

Figure 5:
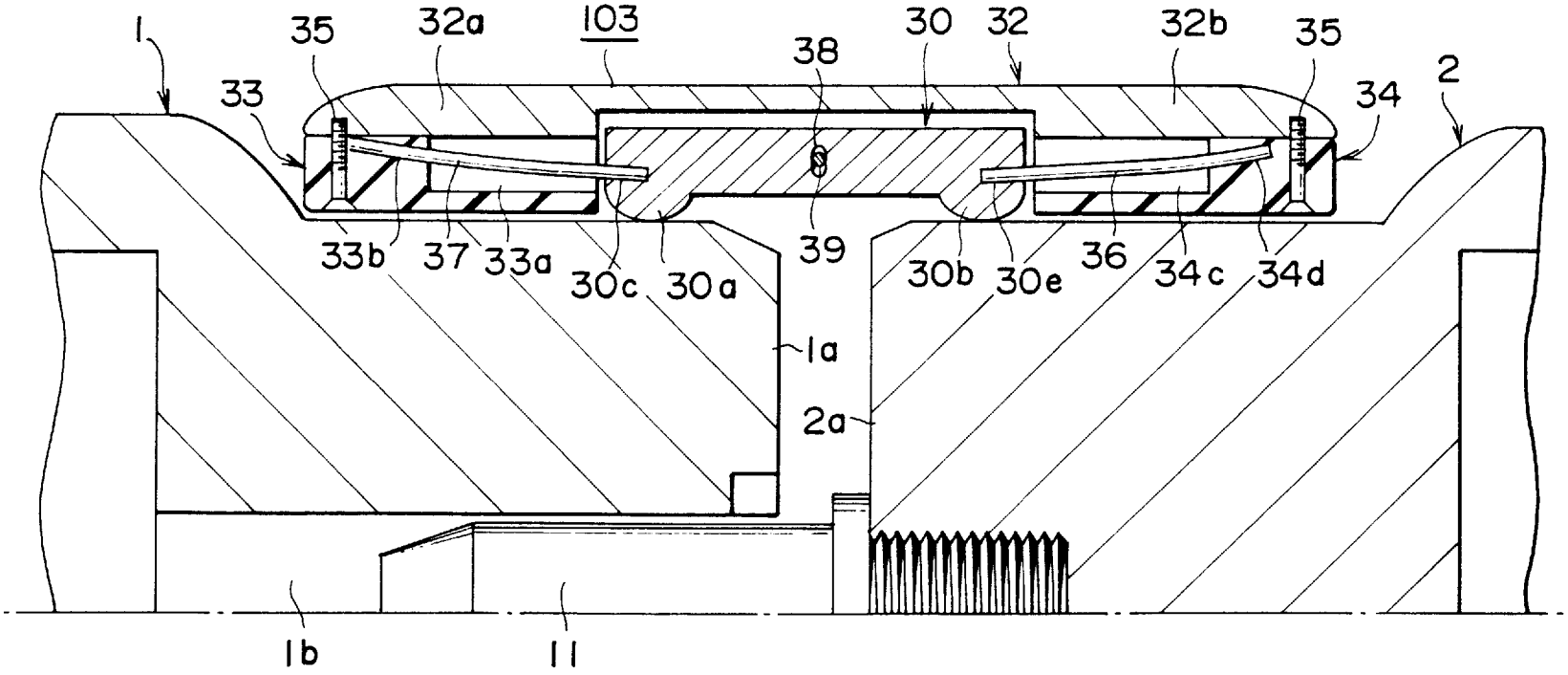
FIG. 5 is a sectional view illustrative of a contact device in accordance with a fourth embodiment of the present invention.

FIG. 5 is a sectional view illustrative of a contact device in accordance with the fourth embodiment of the present invention.

In the drawing, contact sections 30*a*, 30*b* are respectively provided on the inner surfaces in the radial direction on both ends of a contact piece 30. Provided at the center of the contact piece 30 is a through hole 38. Bores 30*c*, 30*e*, in which rod springs 36, 37 are inserted, are provided on both end surfaces of the contact piece 30.

A plurality of the contact pieces 30 are annularly connected by passing a ring 39 through the through hole 38. The ring 39 has a stretchable joint between adjoining contact pieces like a piston ring so that it is stretchable in the circumferential direction. The through hole 38 is formed to have a diameter slightly larger than the outside diameter of the ring 39.

A mounting ring 33 is provided with bores 33*b*, in which the rod springs 37 are press-fitted, and slit-like notches 33*a* for holding the rod springs 37, the bores 33*b* and the notches 33*a* being arranged at equiangular pitches in the circumferential direction. A mounting ring 34 is provided with bores 34*d*, in which the rod springs 36 are press-fitted, and slit-like notches 34*c* for holding the rod springs 36, the bores 34*d* and the notches 34*c* being arranged at equiangular pitches in the circumferential direction. The mounting rings 33, 34 are secured by mounting bolts 35 to flange sections 32*a*, 32*b* of a shield 32 in such a manner that the bores 33*b*, 34*d* and the notches 33*a*, 34*c* match in the circumferential direction. The notches 33*a*, 34*c* are formed to have slit widths that are slightly larger than the outside diameters of the rod springs 36, 37.

A plurality of the rod springs 36 are provided in the circumferential direction by being cantilever-fixed onto the mounting ring 34, one end of the rod springs 36 being press-fitted in each bore 34*d*. The rod springs 36 are allowed to extend, along the axis of the shield 32, through the notches 34*c* into a recessed section formed by the shield 32 and the mounting rings 33, 34; the projecting other ends are placed in a plurality of circumferentially arranged bores 30*e* of the contact pieces 30. The rod springs 36 urge contact sections 30*b* of the contact pieces 30 inward in the radial direction through the inner wall surfaces of the bores 30*e*.

A plurality of the rod springs 37 are provided in the circumferential direction by being cantilever-fixed onto the mounting ring 33, one end of the rod springs 37 being press-fitted in each bore 33*b*. The rod springs 37 are allowed to extend, along the axis of the shield 32, through the notches 33*a* into a recessed section formed by the shield 32 and the mounting rings 33, 34; the projecting other ends are placed in the bores 30*c* of the contact pieces 30. The rod springs 37 urge contact sections 30*a* of the contact pieces 30 inward in the radial direction through the inner wall surfaces of the bores 30*c*.

The other ends of the rod springs 36, 37 are respectively held against the bottoms of the notches 34*c*, 33*a* to prevent them from moving any further inward in the radial direction.

The rest of the configuration this embodiment is the same as the first embodiment described above.

When a contact device 103 thus configured is used for the electrical connection between the first and second conductors 1, 2, the urging force of the rod springs 36 cantilever-fixed to the mounting ring 34 holds the contact section 30*b* against the outer peripheral surface of the contact section 2*a* of the second conductor 2, and the urging force of the rod springs 37 cantilever-fixed to the mounting ring 33 holds the contact section 30*a* against the outer peripheral surface of the contact section 1*a* of the first conductor 1. This secures the electrical connection between the first conductor 1 and the second conductor 2 through the contact device 103.

Hence, the fourth embodiment also provides the same advantages as those imparted by the first embodiment described above.

In the fourth embodiment, the other ends of the rod springs 36, 37 cantilever-fixed to the mounting rings 33, 34, respectively, are inserted in the bores 30*c*, 30*e* provided on both end surfaces of the contact pieces 30 to urge the contact pieces 30 inward in the radial direction. Therefore, according to the fourth embodiment, although the axial length of the shield 32 is increased, the need for providing the outer peripheral surfaces at both top and bottom of the contact pieces 30 with the grooves 31*a*, 31*b* can be obviated. This permits an increased area for carrying current and also permits improved machinability of the contact pieces 30.

The rod springs 36, 37 cantilever-fixed to the mounting rings 33, 34 extend through the slit-like notches 33*a*, 34*c*; therefore, a plurality of the rod springs 36, 37 are guided by the notches 33*a*, 34*c* and arranged in the circumferential direction, the axial direction thereof being identical to the direction of the axial center of the shield 32. Hence, the axial direction of the contact pieces 30, both ends of which are supported by the rod springs 36, 37, coincide with the direction of the axial center, thus making it possible to control the variations in the contact pressure of the contact pieces 30.

Since a plurality of contact pieces 30 are annularly integrated in the circumferential direction by the stretchable ring 39, the contact pieces 30 urged inward in the radial direction by the rod springs 36, 37 which cantilever-fix the contact pieces do not excessively jut out inward in the radial direction, thus permitting easier connection between the first and second conductors 1, 2.

The gap between the through holes 38 in the contact pieces 30 and the ring 39 is small, preventing the contact pieces 30 from falling in the circumferential direction while the contact device 103 is in use.

In the fourth embodiment described above, the rod springs 36, 37 have the round sections; however, at least one of the rod springs 36, 37 may have a square section. In this case, providing the bores 30*c* or 30*e* (or the bores 30*c*, 30*e*) of the contact pieces 30, in which the rod springs having the square sections are inserted, with square sections (or sections) will restrict the rotation of the contact pieces 30 around the rod springs so as to securely prevent the contact pieces 30 from falling in the circumferential direction, thus making it possible to omit the through holes 38 and the ring 39.

Fifth Embodiment

Figure 6:
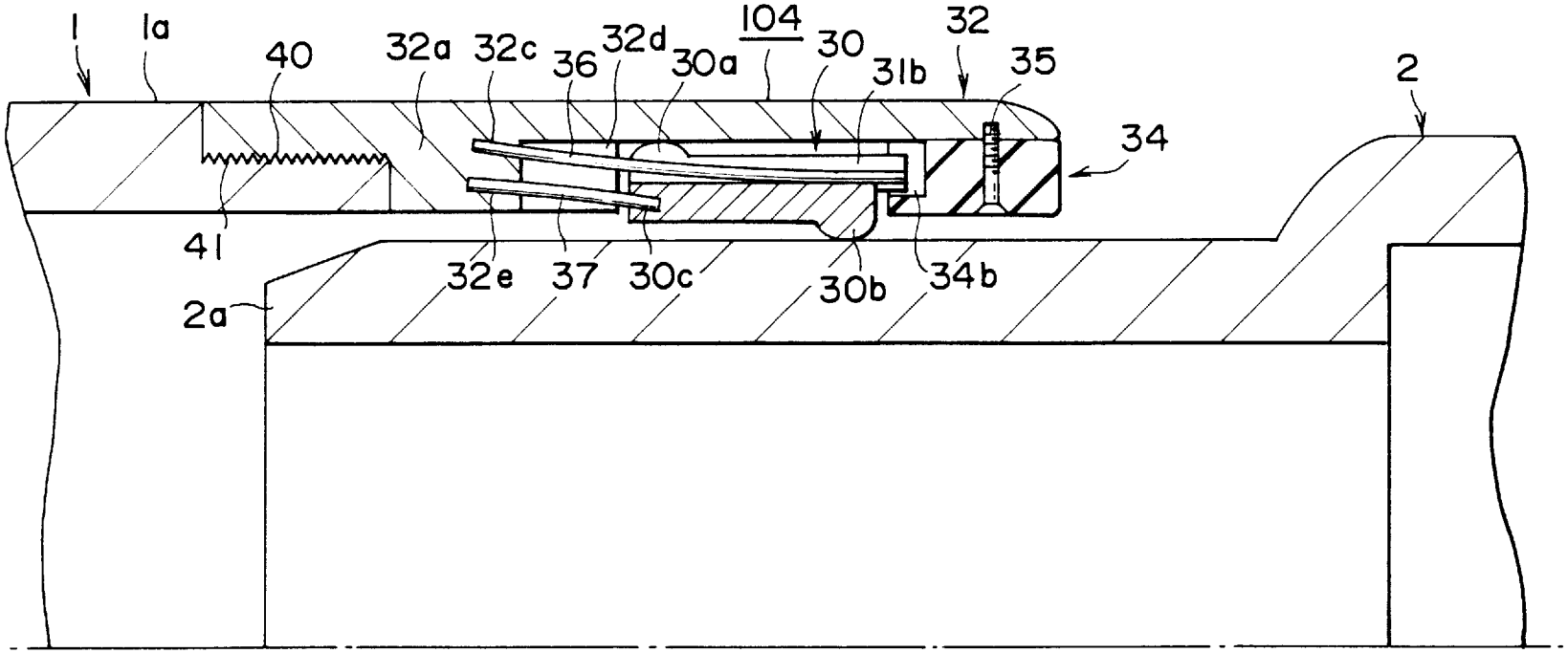
FIG. 6 is a sectional view illustrative of a contact device in accordance with a fifth embodiment of the present invention.

FIG. 6 is a sectional view illustrative of a contact device in accordance with a fifth embodiment of the present invention.

In the drawing, the radial outer surface of a contact piece 30 is provided with a groove 31*b* which extends in the axial direction. Contact sections 30*a* and 30*b* are respectively provided on the radial outer surface on one end of the contact piece 30 and on the radial inner surface on the other end thereof. The surface on one end of the contact piece 30 is provided with a bore 30*c* in which a rod spring 37 is inserted.

Slit-like notches 32*d* are provided on a flange section 32*a* of a shield 32 at equiangular pitches in the circumferential direction. Bores 32*c*, 32*e* in which rod springs 36, 37 are press-fitted are provided radially in the notches 32*d* of the flange section 32*a*. The shield 32 is provided with a female thread 40 on the end thereof where the flange section 32*a* is located.

A mounting ring 34 is provided with notches 34*b* for holding the distal ends of the rod springs 36, the notches 34*b* being arranged in the circumferential direction at the same equiangular pitches as those of the notches 32*d*.

In a contact device 104 according to this embodiment, the mounting ring is secured by a mounting bolt 35 to the shield 32 so that the notches 32*d* and the notches 34*b* face each other. One end of the rod spring 36 and one end of the rod spring 37 are press-fitted in the bores 32*c* and 32*e*, respectively, and cantilever-fixed on the flange section 32*a*; a plurality of the rod springs 36, 37 are arranged radially in double rows in the circumferential direction. The respective rod springs 36 go through the notches 32*d* and extend in parallel to the axial center of the shield 32 into a recessed section formed by the shield 32 and the mounting ring 34; the projecting other ends thereof are placed in grooves 31*b* of the contact pieces 30, the grooves 31*b* being arranged in the circumferential direction, and the other ends are eventually placed in the notches 34*b* of the mounting ring 34. The rod springs 37 extend from the notches 32*d*; the other ends thereof are inserted in the bores 30*c* of the contact pieces 30. At this time, the rod springs 37 urge the contact sections 30*a* of the contact pieces 30 outward in the radial direction, whereas the rod springs 36 urge the contact sections 30*b* of the contact pieces 30 inward in the radial direction. Thus, the contact pieces 30 are supported by the shield 32 with the contact sections 30*a* held against the inner wall surface of the shield 32 by the urging force of the rod springs 37, whereas the contact sections 30*b* projecting inward in the radial direction so that the ends of the rod springs 36 are held against the bottoms of the notches 34*b*. A pair of the rod springs 36, 37 prevents each contact piece 30 from falling in the circumferential direction.

The procedure for connecting a first conductor 1 and a second conductor 2 by using the contact device 104 will now be described.

First, the female thread 40 of the shield 32 is screwed onto a male thread 41 provided on a contact section 1*a* of the first conductor 1 to secure the contact device 104 to the first conductor 1. At this time, the contact sections 30*a* of the contact pieces 30 of the contact device 104 are held against the inner wall surface of the shield 32 by the urging force of the rod springs 37. The contact sections 30*b* of the contact pieces 30 jut out inward in the radial direction by being urged by the rod springs 36 which have ends thereof held against the bottoms of the notches 34*b*.

Then, the second conductor 2 is inserted from the end where the mounting ring 34 is located. At this time, the respective contact sections 30*b* are pushed up to the outer peripheral surface of a contact section 2*a* of the second conductor 2 against the urging force of the rod springs 36. The second conductor 2 is pushed in while the outer peripheral surface of the contact section 2*a* is sliding in contact with the outer peripheral surface of each contact section 30*b*.

The urging force of the rod springs 37 causes the contact section 30*a* to come in contact with the inner wall surface of the shield 32, while the urging force of the rod spring 36 causes the contact section 30*b* to come in contact with the outer peripheral surface of the contact section 2*a*. Thus, the electrical connection between the first and second conductors 1, 2 is accomplished through the contact device 104.

Hence, the fifth embodiment also provides the same advantages as those presented by the first embodiment described above.

The fifth embodiment can be ideally used for an application where an extremely long slide is required for the contact device. Specifically, since the conductor 2 moves inside the first conductor 1, a longer sliding distance can be obtained even when the contact device is short.

The flection of the rod springs 37 does not change during use, enabling the variations in the flection to be minimized at design stage; the rod springs 37 can be made shorter than the rod springs 36. This permits a reduced axial length of the contact device 104.

Further, since the rod springs 36, 37 cantilever-fixed on the flange section 32*a* are radially arranged and placed in the slit-like notches 32*d*, a plurality of the rod springs 36, 37 can be radially arrayed in double rows in the circumferential direction, the axial directions thereof being matched to the direction of the axial center of the shield 32. This makes the axial direction of the contact pieces 30 elastically supported by the rod springs 36, 37 coincide with the direction of the axial center. When attaching the contact device 104, the rod springs 36, 37 are guided by the notched 32*d* and the contact pieces 30 move in the radial direction while being prevented from falling in the circumferential direction, thus enabling the variations in the contact pressure of the contact pieces 30 to be suppressed.

Sixth Embodiment

Figure 7:
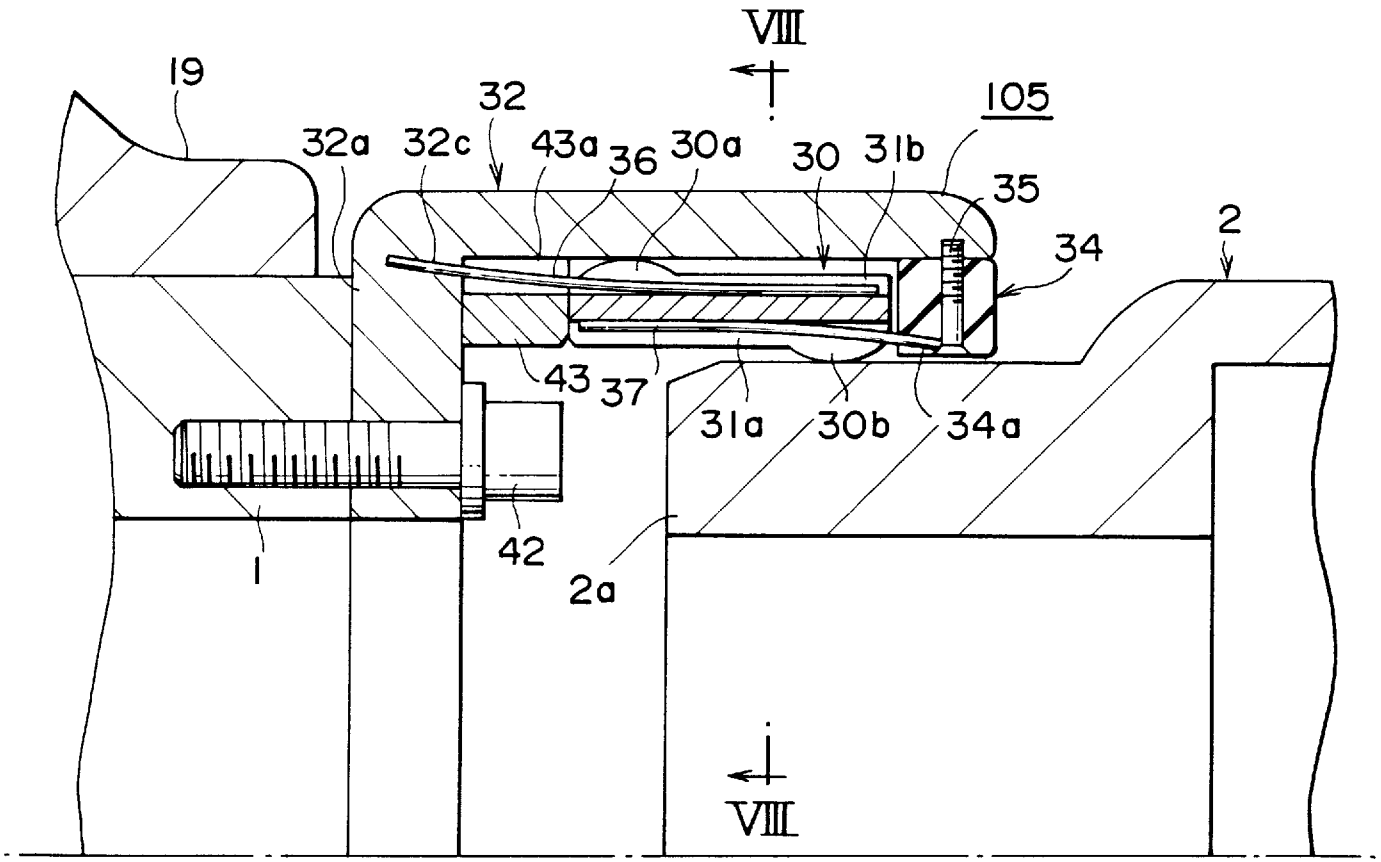
FIG. 7 is a sectional view illustrative of a contact device in accordance with a sixth embodiment of the present invention.
Figure 8:
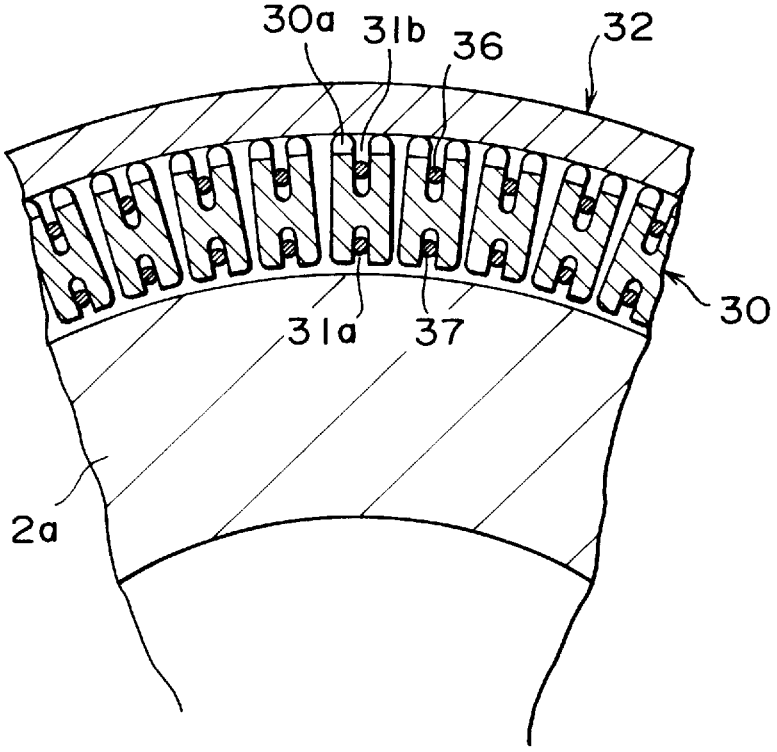
FIG. 8 is a fragmentary view taken in the direction of the arrows along the line VIII—VIII of FIG. 7.

FIG. 7 is a sectional view illustrative of a contact device in accordance with the sixth embodiment of the present invention; and FIG. 8 is a fragmentary view taken in the direction of the arrows along the line VIII—VIII of FIG. 7.

In the drawings, a contact piece 30 has an H-shaped section; it has grooves 31*a* and 31*b* formed on the inner and outer surfaces thereof in the radial direction. The contact piece 30 has a contact section 30*a* provided on the radial outer surface on one end thereof, and a contact section 30*b* provided on the radial inner surface on the other end thereof. A flange 32*a* extends inward in the radial direction at one end of a shield 32; it is secured to a first conductor 1 by a mounting bolt 42. The flange section 32*a* has a plurality of bores 32*c* which are arrayed at equiangular pitches in the circumferential direction. A mounting ring 34 is provided with a plurality of bores 34*a* which are arrayed at the same equiangular pitches as those of the bores 32*c* in the circumferential direction. The mounting ring 34 is secured to the other end of the shield 32 by a mounting bolt 35 so that the bores 32*c* and 34*a* face each other. A spacer 43 is disposed in the shield 32 in such a manner that it comes in contact with the flange section 32*a*. A plurality of slit-like notches 43*a* are circumferentially provided on the spacer 43 at the same pitches as those of the bores 32*c*.

A plurality of rod springs 36 are press-fitted in the respective bores 32*c* and cantilever-fixed on the flange section 32*a*; they are arranged in the circumferential direction. The respective rod springs 36 go through the notches 43*a* and extend in parallel to the axial center of the shield 32 into the recessed section formed by the shield 32 and the mounting ring 34, the projecting other ends thereof being placed in the grooves 31*b* of the contact pieces 30. A plurality of rod springs 37 are press-fitted in the bores 34*a* and cantilever-fixed on the mounting ring 34; they are arranged in the circumferential direction. The respective rod springs 37 extend from the mounting ring 34 in parallel to the axial center of the shield 32 into the recessed section formed by the shield 32 and the mounting ring 34, the projecting other ends thereof being placed in the grooves 31*a* of the contact pieces 30.

At this time, the rod springs 37 urge the contact sections 30*a* of the contact pieces 30 outward in the radial direction, whereas the rod springs 36 urge the contact sections 30*b* of the contact pieces 30 inward in the radial direction. Thus, the contact pieces 30 are supported by the shield 32 with the contact sections 30*a* in contact with the inner wall surface of the shield 32 by the urging force of the rod springs 37, whereas the contact sections 30*b* projecting inward in the radial direction so that they come in contact with the proximal ends of the rod springs 37. A pair of the rod springs 36, 37 prevents each contact piece 30 from falling in the circumferential direction.

The first conductor 1 and a second conductor 2 are supported by a metallic vessel, not shown, in an insulated state by an insulating spacer 19.

The procedure for connecting the first conductor 1 and the second conductor 2 by using a contact device 105 will now be described.

First, the flange section 32*a* of the shield 32 is screwed to the end of the first conductor 1 by the mounting bolt 42 so as to secure the contact device 105 to the first conductor 1. At this time, the contact sections 30*a* of the contact pieces 30 of the contact device 105 are in contact with the inner wall surface of the shield 32 by the urging force of the rod springs 37. The contact sections 30*b* of the contact pieces 30 project inward in the radial direction by being urged by the rod springs 36 inward in the radial direction. The amount of the inward radial projection of the contact sections 30*b* of the contact pieces 30 is restricted by the bottoms of the grooves 31*a* which are in contact with the proximal ends of the rod springs 37.

Then, the second conductor 2 is inserted from the end where the mounting ring 34 is located. At this time the contact sections 30*b* are pushed up to the outer peripheral surface of the contact section 2*a* of the second conductor 2 against the urging force of the rod springs 36. The second conductor 2 is pushed in while the outer peripheral surface of the contact section 2*a* slides on the outer peripheral surfaces of the contact sections 30*b*.

Thus, the urging force of the rod springs 37 causes the contact section 30*a* to come in contact with the inner wall surface of the shield 32, while the urging force of the rod spring 36 causes the contact section 30*b* to come in contact with the outer peripheral surface of the contact section 2*a*, thereby securing the electrical connection between the first and second conductors 1, 2 through the contact device 104.

Hence, the sixth embodiment also provides the same advantages as those presented by the fifth embodiment described above.

In most gas insulated switching gears, a conductor is supported, in an insulated state, by a metal vessel through the insulating spacer 19. An electrode for relieving electric field is provided in the vicinity of the insulating spacer 19 of the conductor.

In the sixth embodiment, the contact device 105 has one end of the shield 32 extending inward in the radial direction; the extended portion thereof is secured by the mounting bolt 42 onto the end of the first conductor 1 which is supported in the insulated state by the metal vessel through the insulating spacer 19. Therefore, the shield 32 serves also as the electrode for relieving electric field which is provided in the vicinity of the insulating spacer 19. This makes it possible to obviate the need for the electrode for relieving electric field, leading to a reduced number of components.

Seventh Embodiment

Figure 9:
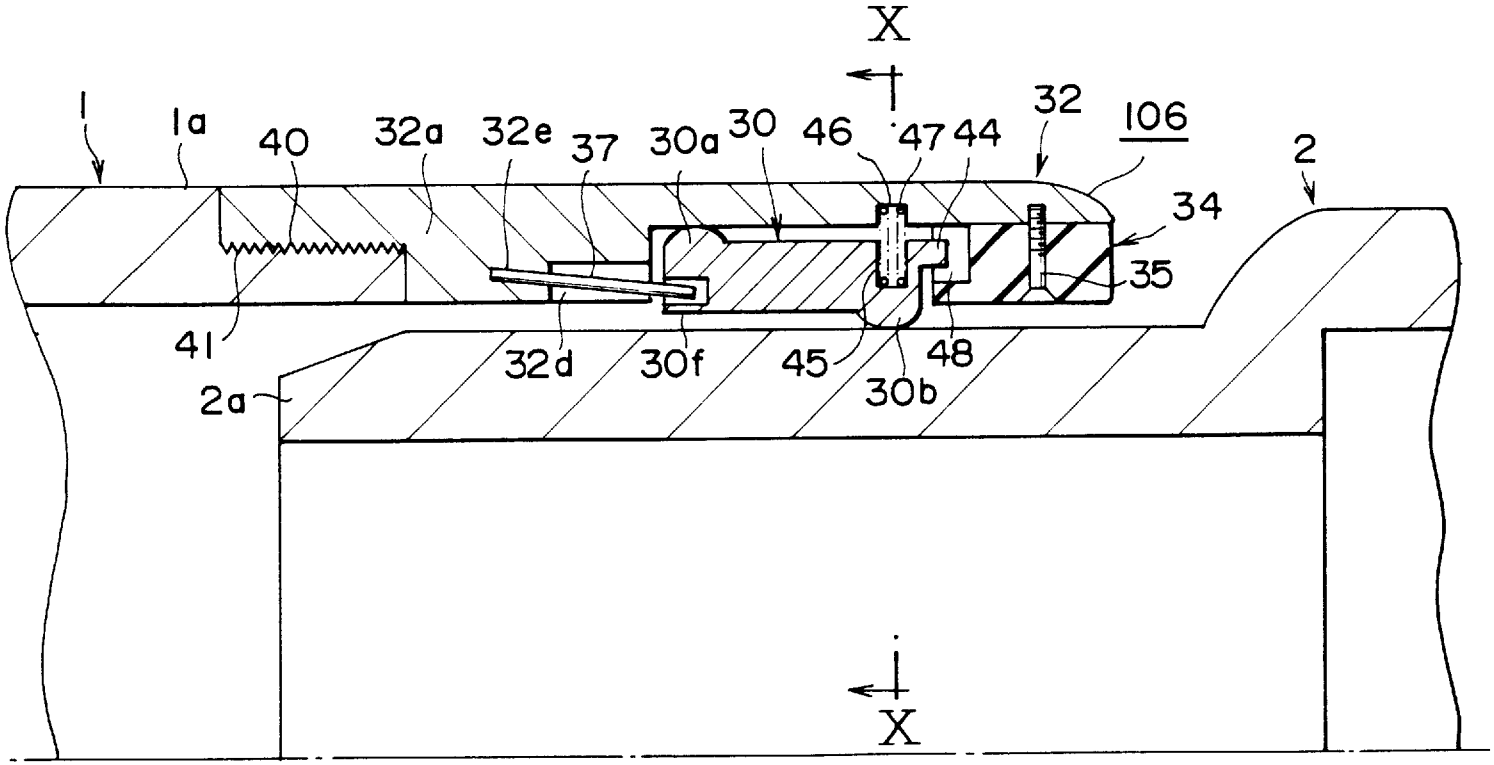
FIG. 9 is a sectional view illustrative of a contact device in accordance with a seventh embodiment of the present invention.
Figure 10:
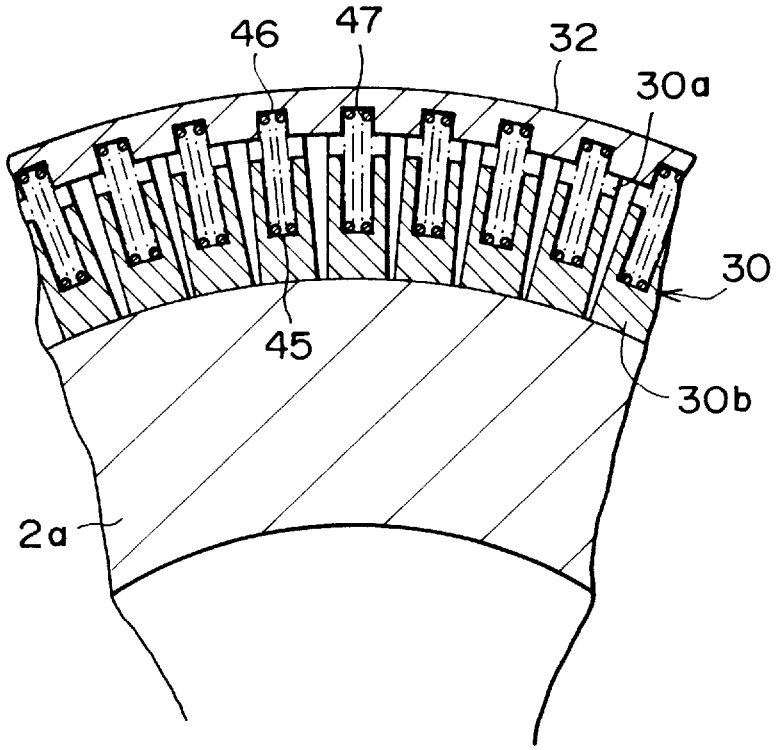
FIG. 10 is a fragmentary view taken in the direction of the arrows along the line X—X of FIG. 9.

FIG. 9 is a sectional view illustrative of a contact device in accordance with a seventh embodiment of the present invention; and FIG. 10 is a fragmentary view taken in the direction of the arrows along the line X—X of FIG. 9.

In the drawings, contact sections 30*a* and 30*b* are respectively provided on the radial outer surface on one end of the contact piece 30 and on the radial inner surface on the other end thereof. The surface on one end of the contact piece 30 is provided with a bore 30*f* in which a rod spring 37 is inserted. The surface on the other end of the contact piece 30 is provided with a lug 44 serving as a stopper. Further, the radial outer surface of the contact section 30*b* of the contact piece 30 is provided with a bore 45 for holding one end of a helical spring 47.

Slit-like notches 32*d* are provided at equiangular pitches in the circumferential direction on a flange section 32*a* of a shield 32. Bores 32*e* in which rod springs 37 are press-fitted are provided at the notches 32*d* of the flange section 32*a*. The inner circumferential surface of the shield 32 is provided with a plurality of bores 46 for holding the other ends of the helical springs 47, the bores 46 being arranged at equiangular pitches in the circumferential direction.

Provided on a mounting ring 34 are slit-like notches 48 for holding the lugs 44 of the contact pieces 30, the notches 48 being arranged in the circumferential direction at the same equiangular pitches as those of the notches 32*d*. A female screw 40 is provided on the end of the flange section 32*a* of the shield 32.

In a contact device 106, the mounting ring 34 is secured by a mounting bolt 35 to the shield 32 so that the notches 32*d* are opposed to the notches 48. A plurality of the rod springs 37 are provided in the circumferential direction by being cantilever-fixed onto the flange section 32*a*, one end of the rod springs 37 being press-fitted in each bore 32*e*. The rod springs 37 are allowed to extend, along the axis of the shield 32, through the notches 32*d* into a recessed section formed by the shield 32 and the mounting ring 34; the projecting other ends are placed in the bores 30*f* of the contact pieces 30. The lugs 44 of the contact pieces 30 are placed in the notches 48 of the mounting ring 34. Both ends of the helical springs 47 are placed in the bores 45, 46 so as to compress and locate the springs 47 between the shield 32 and the contact pieces 30.

At this time, the rod springs 37 urge contact sections 30*a* of the contact pieces 30 radially outward, whereas the helical springs 47 urge the contact sections 30*b* of the contact pieces 30 radially inward. Thus, the contact pieces 30 are supported by the shield 32 with the contact sections 30*a* in contact with the inner wall surface of the shield 32 by the urging force of the rod springs 37, whereas the contact sections 30*b* projecting inward in the radial direction so that the lugs 44 come in contact with the bottoms of the notches 48 by the urging force of the helical springs 47.

The procedure for connecting the first conductor 1 and the second conductor 2 by using the contact device 106 will now be described.

First, the female screw 40 of the shield 32 is screwed to a male screw 41 provided on a contact section 1*a* of the first conductor 1 so as to secure the contact device 106 to the first conductor 1. At this time, the contact sections 30*a* of the contact pieces 30 of the contact device 106 are in contact with the inner wall surface of the shield 32 by the urging force of the rod springs 37. The other ends of the contact pieces 30 are urged by the helical springs 47 and the lugs jut out inward in the radial directional until they come in contact with the bottoms of the notches 48.

Then, the second conductor 2 is inserted from the end where the mounting ring 34 is located. At this time the contact sections 30*b* are pushed up to the outer peripheral surface of the contact section 2*a* of the second conductor 2 against the urging force of the helical springs 47. The second conductor 2 is pushed in while the outer peripheral surface of the contact section 2*a* slides on the outer peripheral surfaces of the contact sections 30*b*.

Thus, the urging force of the rod springs 37 causes the contact section 30*a* to come in contact with the inner wall surface of the shield 32, while the urging force of the helical springs 47 causes the contact section 30*b* to come in contact with the outer peripheral surface of the contact section 2*a*, thereby securing the electrical connection between the first and second conductors 1, 2 through the contact device 106.

Hence, the seventh embodiment also provides the same advantages as those presented by the fifth embodiment described above.

Eighth Embodiment

Figure 11:
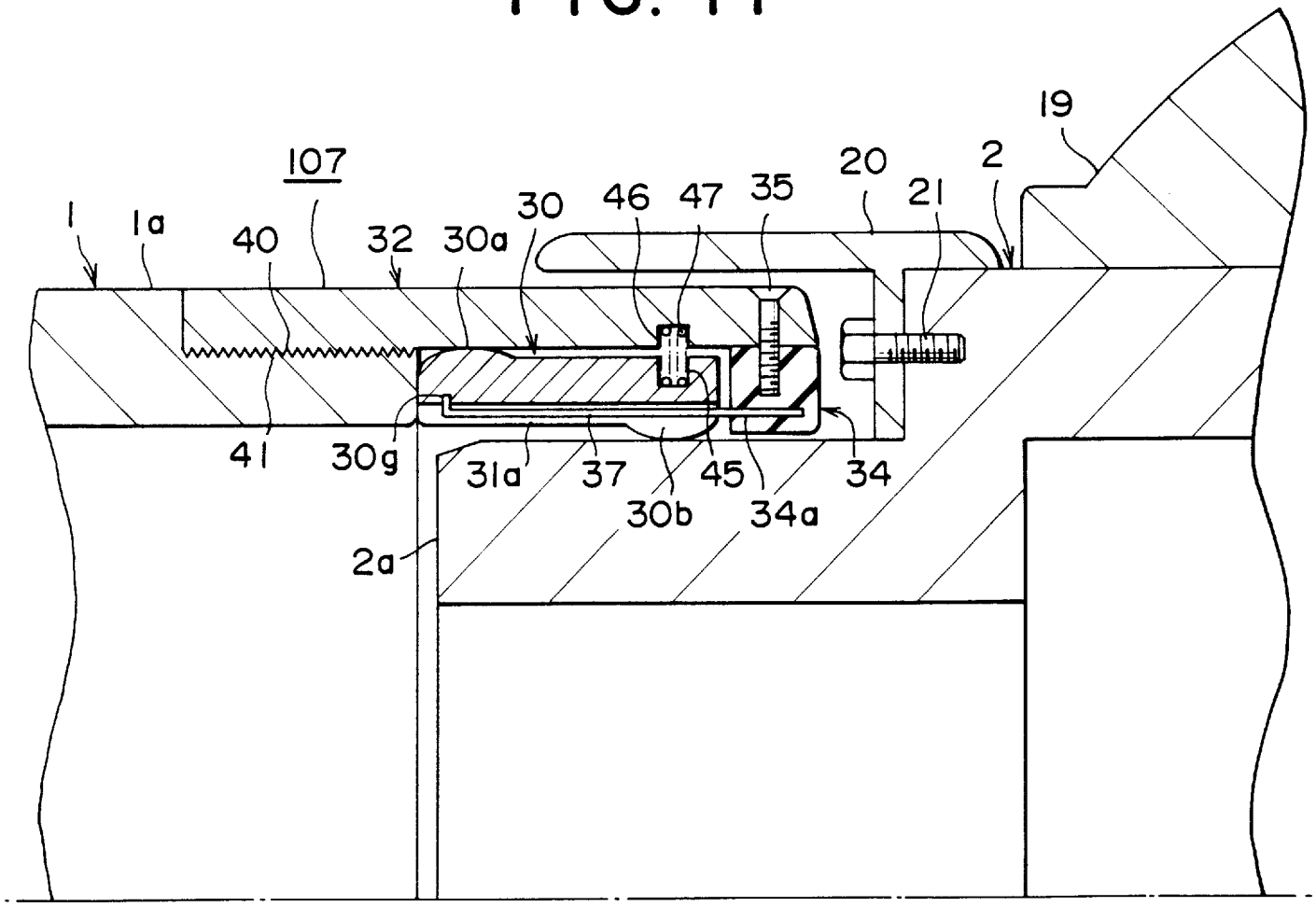
FIG. 11 is a sectional view illustrative of a contact device in accordance with an eighth embodiment of the present invention.

FIG. 11 is a sectional view illustrative of a contact device in accordance with an eighth embodiment of the present invention.

According to the eighth embodiment, a rod spring 37 is formed in such a manner that it is warped in the opposite direction in a free state so that it is straightened in a state where pressing force is generated during use. The other end of the rod spring 37 is bent to an L-shape. Contact sections 30*a* and 30*b* are respectively provided on the radial outer surface on one end of the contact piece 30 and on the radial inner surface on the other end thereof. The radial inner surface of the contact piece 30 is provided with a groove 31*a* which extends in the axial direction. The bottom of the groove 31*a* at one end of the contact piece 30 has a bore 30*g* provided in the radial direction.

A plurality of the rod springs 37 are arranged in the circumferential direction, one end thereof being press-fitted in a bore 34*a* of a mounting ring 34 so that they are cantilever-fixed. The rod springs 37 extending from the mounting ring 34 are placed in the grooves 31*a*, and the other ends thereof which are bent are inserted in the bores 30*g*.

The rest of the configuration of the eighth embodiment is identical to the seventh embodiment described above.

In a contact device 107 according to the eighth embodiment, the mounting ring 34 is secured to the shield 32 by a mounting bolt 35. A plurality of the rod springs 37 are provided in the circumferential direction by being cantilever-fixed onto the mounting ring 34, one end of the rod springs 37 being press-fitted in each bore 34*a*. The rod springs 37 are allowed to extend from the mounting ring 34 in parallel to the axial center of the shield 32 into a recessed section formed by the shield 32 and the mounting ring 34; the projecting sections thereof are placed in the grooves 31*a*, whereas the other ends are inserted in the bores 30*g*. Both ends of the helical springs 47 are placed in the bores 45, 46 so as to compress and locate the springs 47 between the shield 32 and the contact pieces 30.

At this time, the rod springs 37 urge contact sections 30*a* of the contact pieces 30 radially outward, whereas the helical springs 47 urge the contact sections 30*b* of the contact pieces 30 radially inward. Thus, the contact pieces 30 are supported by the shield 32 with the contact sections 30*a* in contact with the inner wall surface of the shield 32 by the urging force of the rod springs 37, whereas the bottoms of the grooves 31*a* on the end where the contact sections 30*b* are located are in contact with the proximal ends of the rod springs 37 by the urging force of the helical springs 47.

The procedure for connecting the first conductor 1 and the second conductor 2 by using the contact device 107 will now be described.

First, a female screw 40 of the shield 32 is screwed to a male screw 41 provided on a contact section 1*a* of the first conductor 1 so as to secure the contact device 107 to the first conductor 1. At this time, the contact sections 30*a* of the contact pieces 30 of the contact device 107 are in contact with the inner wall surface of the shield 32 by the urging force of the rod springs 37. The other ends of the contact pieces 30 are urged by the helical springs 47 and project radially inward until the bottoms of the grooves 31*a* come in contact with the proximal ends of the rod springs 37.

Then, the second conductor 2 is inserted from the end where the mounting ring 34 is located. At this time the contact sections 30*b* are pushed up to the outer peripheral surface of the contact section 2*a* of the second conductor 2 against the urging force of the helical springs 47. The second conductor 2 is pushed in while the outer peripheral surface of the contact section 2*a* slides on the outer peripheral surfaces of the contact sections 30*b*.

Thus, the urging force of the rod springs 37 causes the contact section 30*a* to come in contact with the inner wall surface of the shield 32, while the urging force of the helical springs 47 causes the contact section 30*b* to come in contact with the outer peripheral surface of the contact section 2*a*, thereby securing the electrical connection between the first and second conductors 1, 2 through the contact device 107.

Hence, the eighth embodiment also provides the same advantages as those presented by the seventh embodiment described above.

In the eighth embodiment, the rod springs 37 are warped in the free state where no spring force is generated, whereas they are deformed and straightened during use. Therefore, when the contact device 107 has been assembled, the essential portions of the rod springs 37 are nearly parallel to the direction of the axial center of the shield 32. This makes it possible to reduce the depth of the grooves 31*a* wherein the rod springs 37 are fitted in, enabling the current carrying sectional area of the contact pieces 30 to be increased.

Other embodiments, wherein the rod springs are put in the grooves of the contact pieces, will also provide the advantage of the increased current carrying sectional area of the contact pieces as in the case of the eighth embodiment if the rod springs which bend in the free state and nearly straighten during use are employed.

Ninth Embodiment

Figure 12:
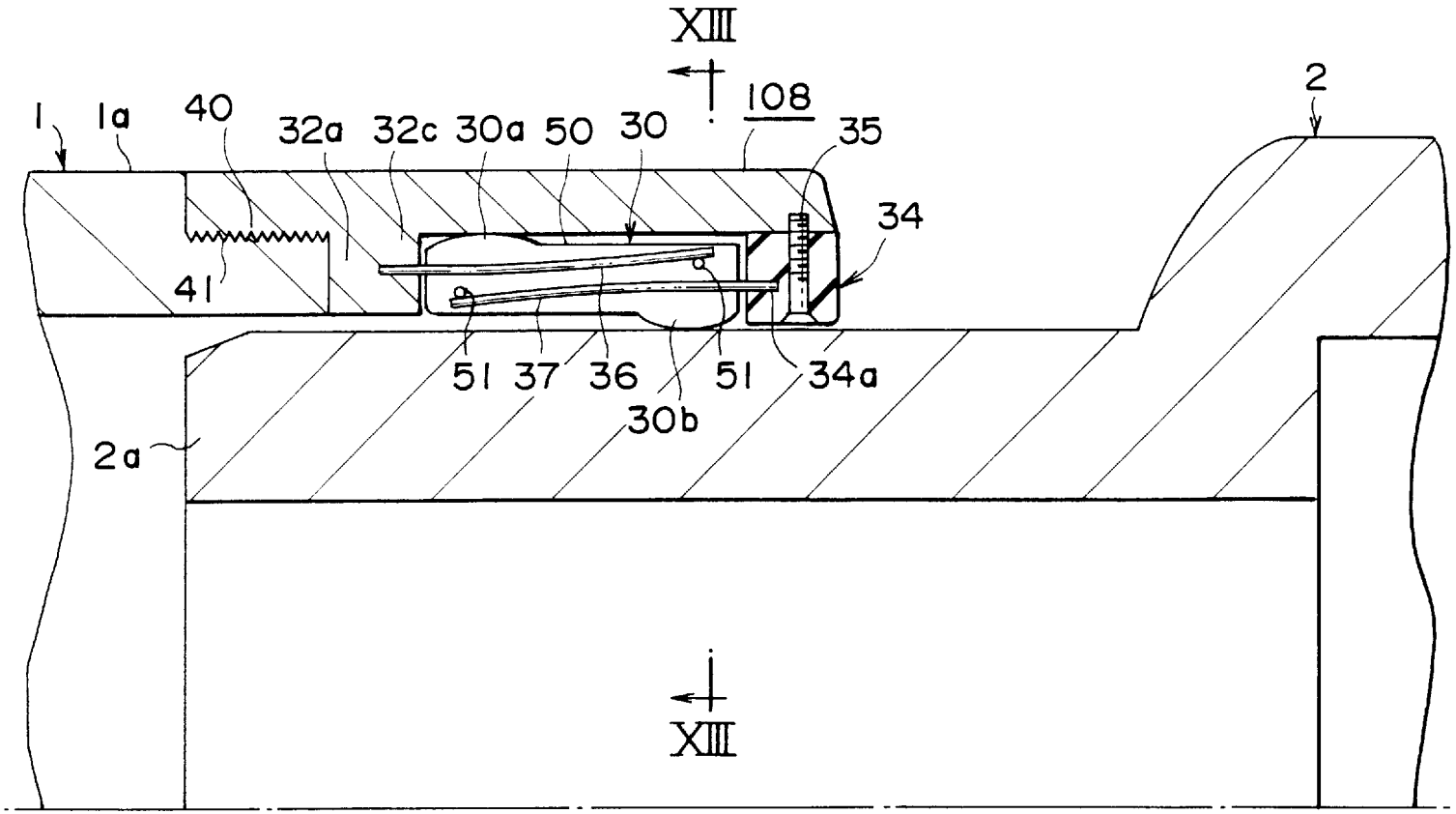
FIG. 12 is a sectional view illustrative of a contact device in accordance with a ninth embodiment of the present invention.
Figure 13:
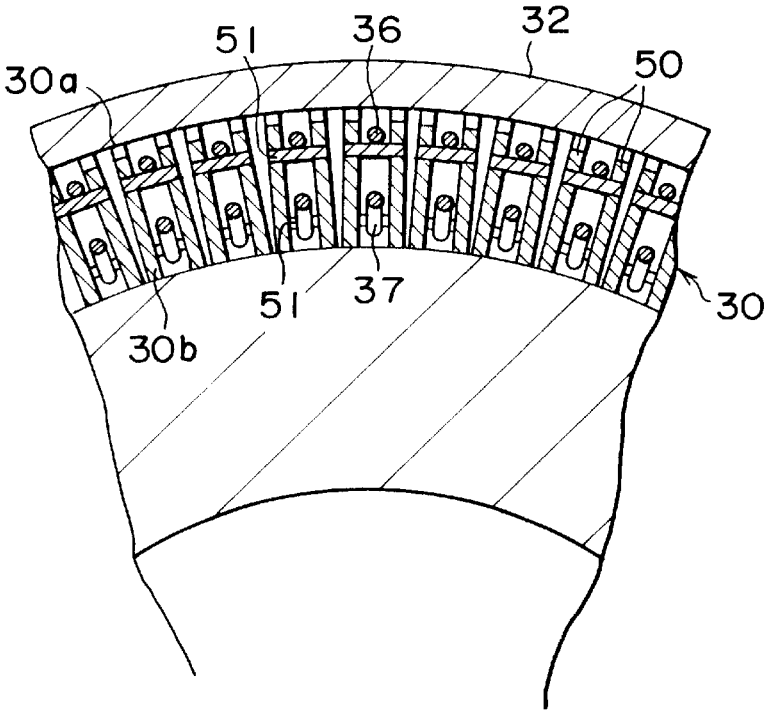
FIG. 13 is a fragmentary view taken in the direction of the arrows along the line XIII—XIII of FIG. 12.

FIG. 12 is a sectional view illustrative of a contact device in accordance with a ninth embodiment of the present invention; and FIG. 13 is a fragmentary view taken in the direction of the arrows along the line XIII—XIII of FIG. 12.

In the drawings, a contact plate 50 has a contact section 30*a* on the top outer peripheral surface on one end thereof and a contact section 30*b* on the radially inner surface at the other end. Two contact plates 50 are disposed so that they are opposed to each other with a predetermined gap provided between them; their both ends are connected into one piece by using connecting pins 51 to constitute a contact piece 30.

In a contact device 108 according to the ninth embodiment, a plurality of rod springs 36 are provided at equiangular pitches in the circumferential direction, one end there of being press-fitted in bores 32*c* provided on a flange section 32*a* of a shield 32 at equiangular pitches in the circumferential direction and cantilever-fixed to the flange section 32*a*. Each rod spring 36 passes between a pair of the contact plates 50 constituting the contact piece 30, the other end thereof being in contact with the connecting pin 51 on the end where the contact section 30*b* is located. The respective rod springs 36 urge the contact sections 30*b* of the contact pieces 30 inward in the radial direction via the connecting pins 51.

A mounting ring 34 is secured to the shield 32 by a mounting bolt 35. A plurality of rod springs 37 are provided at equiangular pitches in the circumferential direction by being cantilever-fixed onto the mounting ring 34, one end of the rod springs 37 being press-fitted in bore 34*a* provided on the mounting ring 34 at equiangular pitches in the circumferential direction. Each rod spring 37 passes between a pair of the contact plates 50 constituting the contact piece 30, the other end thereof being in contact with the connecting pin 51 on the end where the contact section 30*a* is located. The respective rod springs 37 urge the contact sections 30*a* of the contact pieces 30 outward in the radial direction via the connecting pins 51.

Thus, the contact pieces 30 are supported by the shield 32 with the contact sections 30*a* in contact with the inner wall surface of the shield 32 by being pushed outward in the radial direction the urging force of the rod springs 37, whereas the connecting pins 51 on the end, where the contact sections 30*b* are located, held in contact with the proximal ends of the rod springs 37 by being pushed inward in the radial direction by the urging force of the rod springs 36.

The procedure for connecting a first conductor 1 and a second conductor 2 by using the contact device 108 will now be described.

First, a female screw 40 of the shield 32 is screwed to a male screw 41 provided on a contact section 1*a* of the first conductor 1 so as to secure the contact device 108 to the first conductor 1. At this time, the contact sections 30*a* of the contact pieces 30 of the contact device 108 are in contact with the inner wall surface of the shield 32 by the urging force of the rod springs 37. The other ends of the contact pieces 30 are urged by the rod springs 36 and they project radially inward until the connecting pins 51 come in contact with the proximal ends of the rod springs 37.

Then, the second conductor 2 is inserted from the end where the mounting ring 34 is located. At this time the contact sections 30*b* are pushed up to the outer peripheral surface of the contact section 2*a* of the second conductor 2 against the urging force of the rod spring 36. The second conductor 2 is pushed in while the outer peripheral surface of the contact section 2*a* slides on the outer peripheral surfaces of the contact sections 30*b*.

The urging force of the rod springs 37 causes the contact section 30*a* to come in contact with the inner wall surface of the shield 32, thereby securing the electrical connection between the first and second conductors 1, 2 through the contact device 108.

Hence, the ninth embodiment also provides the same advantages as those presented by the seventh embodiment described above.

In the ninth embodiment, the contact pieces 30 are connected into one piece by a pair of the contact plates 50 linked using the connecting pins 51. The contact plates 50 be easily formed by, for example, stamping a plate. Moreover, the holes in which the connecting pins 51 are driven can be formed at the same time when the contact plates 50 are made. Hence, the contact pieces 30 can be fabricated by driving the connecting pins 51 to a pair of the contact plates 50 formed by stamping to combine them into one piece, permitting easier fabrication of the contact pieces 30. This fabrication of a contact can be applied also to the first, second, and sixth embodiments.

The present invention thus configured provides the following advantages.

According to the present invention, the contact device is equipped with: an annular shield; a pair of annular flanges provided on both ends of the shield, the flanges extending inward in the radial direction; a plurality of contact pieces which have contact sections projecting on the outer peripheral surfaces at both endsthereof and which are arranged in the circumferential direction in a space formed by the shield and the pair of flanges with the axial direction thereof matched to the parallel direction with the axial center of the shield; and a plurality of rod-shaped elastic members arrayed on the flanges in the circumferential direction, each of the elastic members being cantilever-fixed to the flange in such a manner that one end thereof is secured to an inner edge surface of the flange and the other end thereof is allowed to extend inside the space formed by the shield and the pair of flanges along the axial center of the shield, and which elastically support a plurality of the contact pieces, respectively, to restrict the contact pressure of the contact sections; therefore, the contact device is capable of carrying large current while controlling an increase of the outside diameter thereof.

A plurality of the rod-shaped elastic members are disposed on each of the flanges in the circumferential direction in such a manner that they are opposed to each other, and the respective contact pieces are elastically supported by a pair of the opposed rod-shaped elastic members; therefore, the contact pressure of each contact piece is restricted by the elastic force of the pair of rod-shaped elastic members, thus permitting controlled variations in the contact pressure.

Each contact piece has grooves formed on the inner and outer radial surfaces in the axial direction, and one contact section is formed on the radial inner surface of one end thereof to cover the radial inner groove, whereas the other contact section is formed on the radial inner surface of the other end thereof to expose the radial inner groove; and the rod-shaped elastic member cantilever-fixed on the flange located in one end side of the contact piece is placed in a radial outer groove to urge the other contact section of the contact piece inward in the radial direction, whereas the rod-shaped elastic member cantilever-fixed on the flange located in the other end side of the contact piece is placed in a radial inner groove to urge the one contact section of the contact piece inward in the radial direction; therefore, the rod-shaped elastic members do not jut out outward in the radial direction, making it possible to reduce the outside diameter thereof and to permit stable current carrying performance because adequate contact pressure of each contact piece is secured by a pair of rod-shaped elastic members and the contact pieces are prevented from falling in the circumferential direction.

Each contact piece is provided with bores on both end surfaces thereof, and one contact section thereof is formed on the radial inner surface of one end thereof, whereas the other contact section is formed on the radial inner surface of the other end thereof; and the rod-shaped elastic member cantilever-fixed on the flange located in one end side of the contact piece is loosely fitted in a bore formed on the end surface of one end of the contact piece to urge one contact section of the contact piece inward in the radial direction, whereas the rod-shaped elastic member cantilever-fixed on the flange located in the other end side of the contact piece is loosely fitted in the bore formed on the end surface of the other end of the contact piece to urge the other contact section of the contact piece inward in the radial direction; therefore, the rod-shaped elastic members do not jut out outward in the radial direction, making it possible to reduce the outside diameter thereof and to permit stable current carrying performance because adequate contact pressure of each contact piece is secured by a pair of the rod-shaped elastic members and the contact pieces are prevented from falling in the circumferential direction.

A plurality of the rod-shaped elastic members are arranged on one flange in two rows located away from each other in the circumferential direction, and each contact piece is elastically supported by a pair of the rod-shaped elastic members disposed away from each other in the radial direction; therefore, the length in the axial direction can be reduced.

Each contact piece has a groove formed on the radial outer surface thereof in the axial direction and a bore provided on the end surface of one end thereof, and one contact section is formed on the radial inner surface of one end, whereas the other contact section is formed on the radial inner surface of the other end; a rod-shaped elastic member on an outer periphery end, which is cantilever-fixed on the flange located in one end side of the contact piece, is placed in the groove to urge the other contact section of the contact piece inward in the radial direction, whereas a rod-shaped elastic member on an inner periphery end, which is cantilever-fixed on the flange located in one end side of the contact piece, is loosely fitted in the bore formed on the surface of one end of the contact piece to urge the one contact section of the contact piece inward in the radial direction; therefore, the rod-shaped elastic members do not jut out outward in the radial direction, making it possible to reduce the outside diameter thereof and to permit stable current carrying performance because adequate contact pressure of each contact piece is secured by a pair of the rod-shaped elastic members and the contact pieces are prevented from falling in the circumferential direction.

Further, since the flanges are secured to the shield by tightening members, the assemblability of the contact device can be improved.

Since the flanges are composed of electrical insulators, it is possible to prevent current from being branched when carrying current.

One end of the shield is removably attached to one of the pair of conductors to be electrically connected, permitting a reduced length in the axial direction.

The shield is configured so that one end thereof extends in the parallel direction with the axial center thereof, and the extended portion is attached to one of the pair of conductors to be electrically connected. Each contact piece has a groove formed on the radial outer surface thereof in the axial direction, a bore provided on the end surface of one end thereof, one contact section formed on the radial outer surface of one end thereof to expose the groove, and the other contact section formed on the radial inner surface of the other end thereof. A rod-shaped elastic member on a radial outer end, which is cantilever-fixed on the flange located in one end side of the contact piece, is placed in the groove to urge the other contact section of the contact piece inward in the radial direction, whereas a rod-shaped elastic member on a radial inner end, which is cantilever-fixed on the flange located in one end side of the contact piece, is loosely fitted in the bore formed on the end surface of one end of the contact piece to urge the one contact section of the contact piece outward in the radial direction so as to cause the one contact section to come in contact with the inner peripheral wall surface of the shield, thus making it possible to reduce the axial length and to reduce the silver plating area provided for improved current carrying performance with a resultant lower cost.

The rod-shaped elastic members which impart the force for holding the contact pieces against the inner side of the shield are made shorter than the rod-shaped elastic members which impart the force for holding the contact piece against the conductors, thus allowing the overall length of the contact device to be reduced to make the device conveniently used for electric equipment.

The shield is configured so that one end thereof extends, and the extended portion of the shield is attached to one of the pair of conductors; and each contact piece has grooves formed on the radial inner and outer surfaces thereof in the axial direction, one contact section being formed on the radial outer surface of one end thereof to expose the radial outer groove and the other contact section being formed on the radial inner surface of the other end thereof to expose the radial inner groove. A rod-shaped elastic member which is cantilever-fixed on the flange located in one end side of the contact piece is placed in the radial outer groove to urge the other contact section of the contact piece inward in the radial direction, whereas a rod-shaped elastic member which is cantilever-fixed on the flange located in the other end side of the contact piece is placed in the radial inner groove to urge the one contact section of the contact piece outward in the radial direction so as to cause one contact section to come in contact with the inner peripheral wall surface of the shield, thus making it possible to reduce the axial length and to reduce the silver plating area provided for improved current carrying performance with a resultant lower cost. In addition, when the shield is located near an insulating spacer for supporting conductors in an insulated state in connecting the conductors, the shield functions also as an electrode for relieving electric field, so that the electrode for relieving electric field can be omitted.

Each contact piece is constituted by a pair of contact plates and connecting pins which connect both ends of the pair of contact plates with a predetermined gap provided between them; a rod-shaped elastic member cantilever-fixed on the flange is placed in the gap between the pair of contact plates to urge the contact piece in the radial direction via the connecting pins so as to hold the contact section in contact. This makes it possible to achieve easier assembly of the contact pieces, a reduced length in the axial direction, and a reduced area provided with silver plating for improving the current carrying performance with resultant saving in cost.

The contact device according to the invention is equipped with: an annular shield attached to one of a pair of conductors to be electrically connected; a pair of annular flanges which are provided on the inner side of the shield so that they extend inward in the radial direction and face each other in the parallel direction with the axial center; a plurality of slit-like notches which are provided in the circumferential direction on the inner edge surface of the flange of the pair of the flanges, the flange being on the other end of the shield, and which extend in the radial direction; a plurality of contact pieces which are disposed in the circumferential direction in a space formed by the shield and the flanges in such a manner that each axial direction of the contact pieces is matched to the parallel direction with the axial direction of the shield, wherein one contact section is projected on the radial outer surface of one end thereof, whereas the other contact section is projected on the radial inner surface of the other end thereof, a bore is provided on the surface of one end thereof, and a stopper is provided on the end surface of the other end thereof and inserted in the slit-like notch; a plurality of rod-shaped elastic members arrayed on the flanges in the circumferential direction, each of the elastic members being cantilever-fixed to the flange in such a manner that one end thereof is secured to the inner edge surface of the flange located in one end side of the shield and the other end thereof is allowed to extend along the axial center of the shield in a space formed by the shield and the pair of the flanges, and which each other end of the elastic members is inserted in the bore to urge one contact section outward in the radial direction so as to restrict the contact pressure of the one contact section; and a plurality of helical springs which are respectively provided in a compressed state between the radial outer surface of the other end of the contact piece and the shield to restrict the contact pressure of the other contact section. Therefore, the contact device is capable of carrying large current while controlling the increase of the outside diameter thereof and also of ensuring stable current carrying performance since adequate contact pressure of the contact pieces is secured by the rod-shaped elastic members and the helical springs. The contact device also permits a reduced axial length thereof.

The contact device according to the invention is equipped with: an annular shield attached to one of a pair of conductors to be electrically connected; an annular flange which is provided on the other end of the shield so that it extends inward in the radial direction; a plurality of contact pieces which are disposed in the circumferential direction in a space formed by the shield and the flange in such a manner that each axial direction of the contact pieces is matched to the parallel direction with the axial center of the shield, wherein one contact section is projected on the radial outer surface of each one end of the contact pieces, whereas the other contact section is projected on the radial inner surface of each other end of the contact pieces, and a groove is formed on the inner radial surface of the contact pieces in the axial direction; a plurality of rod-shaped elastic members arrayed on the flange in the circumferential direction, each of the elastic members being cantilever-fixed to the flange in such a manner that one end thereof is secured to an inner edge surface of the flange and the other end thereof is allowed to extend into a space formed by the shield and the flange along the axial center of the shield, which each of the elastic members is placed in the groove to urge the one contact section outward in radial direction so as to hold the one contact section against the inner peripheral wall surface of the shield, thereby restricting the contact pressure of the one contact section; and a plurality of helical springs which are respectively provided in a compressed state between the radial outer surface of the other end of the contact piece and the shield to restrict the contact pressure of the other contact section. Therefore, the contact device is capable of carrying large current while controlling the increase of the outside diameter thereof and also of ensuring stable current carrying performance since adequate contact pressure of the contact pieces is secured by the rod-shaped elastic members and the helical springs. The contact device also permits a reduced axial length thereof.

What is claimed is:

1. A contact device comprising:

an annular shield;

a pair of annular flanges provided on both ends of said shield so that the annular flanges extent inward in the radial direction;

a plurality of contact pieces which have contact sections projecting on the outer peripheral surfaces of both ends thereof and which are arranged in the circumferential direction in a space formed by said shield and the pair of said flanges, with the axial direction of the circumferentially arranged contact pieces extending in parallel with the direction defined by the axial center of said shield; and a plurality of rod-shaped elastic members arrayed on the flanges in the circumferential direction, each of said elastic members being cantilever-fixed to one of said flanges by securing one end thereof to an inner edge surface of said one flange and the other end thereof is allowed to extend into said space formed by said shield and said flanges along the axial center of said shield, and wherein said plurality of rod-shaped elastic members apply force against the plurality of said contact pieces, respectively, to urge said contact sections against at least one member of a pair of conductors.

2. A contact device according to claim 1, wherein one end of said shield is removably attached to one of the pair of said conductors to be electrically connected.

3. A contact according to claim 1, wherein:

each of said contact pieces is constituted by a pair of contact plates and connecting pins which connect both ends of the pair of said contact plates with a predetermined gap provided between the contact plates; and said rod-shaped elastic members cantilever-fixed on one of said flanges are placed in said gap between the pair of said contact plates, respectively, to urge said contact pieces in the radial direction via said connecting pins so as to hold said contact sections in contact with said at least one member of the pair of conductors.

4. A contact device according to claim 1, wherein the plurality of said rod-shaped elastic members are provided on both flanges in the circumferential direction to face against each other, and each of said contact pieces is elastically supported by a pair of said rod-shaped elastic members comprising a first and a second elastic members which face against each other.

5. A contact device according to claim 4, wherein:

each of said contact pieces is constituted by a pair of contact plates and connecting pins which connect both ends of the pair of said contact plates with a predetermined gap provided between said contact plates; and said rod-shaped elastic members cantilever-fixed on one of said flanges are placed in said gap between the pair of said contact plates, respectively, to urge said contact pieces in the radial direction via said connecting pins so as to hold said contact sections in contact with said at least one member of a paid or conductors.

6. A contact device according to claim 4, wherein:

each of said contact pieces has grooves formed on the inner and outer radial surfaces thereof in the axial direction, and one contact section is formed on the radial inner surface of one end thereof to cover a radial inner groove of said grooves, and the other contact section is formed on the radial inner surface of the other end thereof to expose said radial inner groove; and said first rod-shaped elastic member cantilever-fixed on a first flange located in the one end side of said contact piece is placed in a radial outer groove of said grooves to urge said other contact section of said contact piece inward in the radial direction, and said second rod-shaped elastic member cantilever-fixed on a second flange located in the other end side of said contact piece is placed in said radial inner groove to urge said one contact section of said contact piece inward in the radial direction.

7. A contact device according to claim 6, wherein said flanges are secured to said shield by tightening members.

8. A contact device according to claim 7, wherein said flanges are composed of electrical insulators.

9. A contact device according to claim 4, wherein:

each of said contact pieces is provided with bores on both end surfaces thereof;

one contact section thereof is formed on the radial inner surface of one end of said contact piece, and the other contact section is formed on the radial inner surface of the other end of said contact piece; and said first rod-shaped elastic member cantilever fixed on a first flange located in the one end side of said contact piece is loosely fitted in said bore formed on the end surface of one end of said contact piece to urge said one contact section inward in the radial direction, and said second rod-shaped elastic member cantilever-fixed on a second flange located in the other end side of said contact piece is loosely fitted in said bore formed on the end surface of the other end of said contact piece to urge said other contact section inward in the radial direction.

10. A contact device according to claim 9 wherein said flanges are secured to said shield by tightening members.

11. A contact device according to claim 10, wherein said flanges are composed of electrical insulators.

12. A contact device according to claim 4, wherein:

said shield is configured so that one end thereof extends in the axial direction to define an extended portion, and the extended portion of said shield is attached to one of the pair of said conductors;

each of said contact pieces has grooves formed on the radial inner and outer surfaces thereof in the axial direction, one contact section being formed on the radial outer surface of one end thereof to expose a radial outer groove of said grooves and the other contact section being formed on the radial inner surface of the other end thereof to expose a radial inner groove of said grooves; and said first rod-shaped elastic member is cantilever-fixed on a first flange located in one end side of said contact piece and is placed in said radial outer groove to urge said other contact section of said contact piece inward in the radial direction, whereas said second rod-shaped elastic member is cantilever-fixed on a second flange located in the other end side of said contact piece and is placed in said radial inner groove to urge said one contact section of said contact piece outward in the radial direction so as to cause said one contact section to come in contact with an inner peripheral wall surface of said shield.

13. A contact device according to claim 1, wherein a plurality of said rod-shaped elastic members are arranged in the circumferential direction on one flange in two rows spaced away from each other in the radial direction, and each of said contact pieces is elastically supported by a pair of said rod-shaped elastic members, comprising a first and second elastic members, disposed away from each other in the radial direction.

14. A contact device according to claim 13, wherein:

each of said contact pieces has a groove formed on the radial outer surface thereof in the axial direction and a bore provided on the end surface of one end thereof;

one contact section of said each of contact pieces is formed on the radial inner surface of the one end of said each of contact pieces, whereas the other contact section is formed on the radial inner surface of the other end of said each of contact pieces; and said first rod-shaped elastic member is located on an outer periphery end, which rod-shaped elastic member is cantilever-fixed on said flange located in the one end side of said contact piece, and is placed in said groove to urge said other contact section of said contact piece inward in the radial direction, whereas said second rod-shaped elastic member is located on an inner periphery end, which rod-shaped elastic member is cantilever-fixed on said flange located in the same one end side of said contact piece, and is loosely fitted in said bore formed on the end surface of the one end of said contact piece to urge said one contact section of said contact piece inward in-the radial direction.

15. A contact device according to claim 14, wherein said flanges are secured to said shield by tightening members.

16. A contact device according to claim 15, wherein said flanges are composed of electrical insulators.

17. A contact device according to claim 13, wherein:

said shield is configured so that on end thereof extends in a direction parallel with the axial center thereof to define an extended portion, and the extended portion is attached to one of the pair of said conductors;

each of said contact pieces has a groove formed on the radial outer surface of said contact piece in the axial direction, a bore provided on the end surface of one end thereof, one contact section formed on the radial outer surface of one end of said contact piece to expose said groove, and the other contact section formed on the radial inner surface of the other end of said contact piece; and said first rod-shaped elastic member is located on a radial outer end, which rod-shaped elastic member is cantilever-fixed on said flange located in one end side of said contact piece, and is placed in said groove to urge said other contact section inward in the radial direction, whereas said second rod-shaped elastic member is located on a radial inner end, which rod-shaped elastic member is cantilever-fixed on said flange located in one end side of said contact piece, and is loosely fitted in said bore formed on the end surface of one end of said contact piece to urge said one contact section outward in the radial direction so as to cause said contact section to come in contact with and inner peripheral wall surface of said shield.

18. A contact device according to claim 17, wherein said rod-shaped elastic members which impart the force for holding said contact pieces against the inner side of said shield are made shorter than rod-shaped elastic members which impart the force for holding said contact pieces against said conductors.

19. A contact device comprising:

and annular shield attached to one pair of conductors to be electrically connected together, said shield having one end and the other end;

a pair of annular flanges which are provided on the inner side of said shield so that said flanges extend inward in the radial direction and face each other in a direction which is parallel with the axial center of said contact device;

a plurality of slit-like notches which are provided in the circumferential direction on the inner edge surface of one flange of the pair of said flanges, said one flange being on the other end of said shield, and which extend in the radial direction;

a plurality of contact pieces which are disposed in the circumferential direction in a space formed by said shield and said flanges, where the axial direction of said circumferentially arranged contact pieces is parallel with the axial center of said shield, wherein for each of said contact piece one contact section is projected on the radial outer surface of one end of the contact piece, whereas the other contact section is projected on the radial inner surface of the other end of the contact piece, further wherein a bore is provided on the end surface of the one end of the contact piece, and a stopper is projected on the end surface of the other end of said contact piece and is inserted in said slit-like notch;

a plurality of rod-shaped elastic members arrayed on said flanges in the circumferential direction, each of said elastic members being cantilever-fixed to one of said flanges by securing one end thereof to an inner edge surface of said one flange which is located in one end side of said shield, and wherein the other end thereof is allowed to extend into a space formed by said shield and said flanges along the axial center of said shield, wherein, for said each of elastic members, the other end of the elastic member is inserted in said bore to urge said one contact section outward in the radial direction so as to affect the contact pressure exerted by the one contact section; and for each of said contact pieces, a helical spring is provided in a compressed state between the radial outer surface of the other end of the contact piece and said shield to affect the contact pressure exerted by said other contact section.

20. A contact device comprising:

an annular shield attached to one of a pair of conductors to be electrically connected together, said shield having one end and the other end;

an annular flange which is provided on the other end of said shield so that said flange extends inward in the radial direction;

a plurality of contact pieces which are disposed in the circumferential direction in a space formed by said shield and said flange, where the axial direction of said circumferentially arranged contact pieces is parallel with the direction defined by the axial center of said shield, wherein, for each of said contact pieces, one contact section is projected on the radial outer surface of one end of the contact piece, whereas the other contact section is projected on the radial inner surface of other end of the contact piece, and a groove is formed on the inner radial surface of the contact piece in the axial direction;

a plurality of rod-shaped elastic members arrayed on said flange in the circumferential direction, wherein, for each of said contact pieces, and elastic member is cantilever-fixed to said flange by securing one end thereof to an inner edge surface of said flange and the other end thereof is allowed to extend into a space formed by said shield and said flange along the axial center of said shield, where said elastic member is placed in said groove to urge said one contact section outward in the radial direction so as to hold said one contact section against an inner peripheral wall surface of said shield, thereby affecting the contact pressure of said one contact section against said wall surface; and for each of said contact pieces, a helical spring is provided in a compressed state between the radial outer surface of the other end of said contact piece and said shield to affect the contact pressure exerted by said other contact section.

* * * * *